US007642970B2

(12) United States Patent
Aoyama et al.

(10) Patent No.: US 7,642,970 B2
(45) Date of Patent: Jan. 5, 2010

(54) ANTENNA DEVICE AND WIRELESS COMMUNICATION APPARATUS USING SAME

(75) Inventors: Hiroyuki Aoyama, Saitama (JP); Kazuo Kazama, Saitama (JP)

(73) Assignee: Hitachi Metals, Ltd., Tokyo (JP)

( * ) Notice: Subject to any disclaimer, the term of this patent is extended or adjusted under 35 U.S.C. 154(b) by 277 days.

(21) Appl. No.: 11/723,388

(22) Filed: Mar. 19, 2007

(65) Prior Publication Data

US 2007/0236394 A1 Oct. 11, 2007

(30) Foreign Application Priority Data

Apr. 10, 2006 (JP) ..... 2006-107178

(51) Int. Cl.
*H01Q 1/24* (2006.01)

(52) U.S. Cl. ..... 343/702; 343/700 MS; 343/895

(58) Field of Classification Search ..... 343/700 MS, 343/702, 895
See application file for complete search history.

(56) References Cited

U.S. PATENT DOCUMENTS 7,038,626 B2 * 5/2006 Gothard et al. ..... 343/702
7,180,464 B2 * 2/2007 Chiang et al. ..... 343/833
7,453,404 B2 * 11/2008 Ying ..... 343/702
2005/0237244 A1 * 10/2005 Annabi et al. ..... 343/702
2007/0285321 A1 * 12/2007 Chung et al. ..... 343/702

FOREIGN PATENT DOCUMENTS

JP 2004-088218 3/2004

* cited by examiner

*Primary Examiner*—Tan Ho
(74) *Attorney, Agent, or Firm*—McGinn IP Law Group, PLLC

(57) ABSTRACT

An antenna device is provided which is capable of operating in a wider band of frequencies (in a plurality of transmitting and receiving frequency bands), achieving an excellent gain, maintaining non-directivity of vertically polarized waves in each of the transmitting and receiving frequency bands, and saving space. The antenna device includes the first antenna 101 being a chip-type antenna operating in a GSM band, second antenna 102 being a pattern antenna operating in DCS and PCS bands, third antenna 103 being a layer-stacked antenna operating in an UMTS band, all being mounted on a substrate 100. The second antenna 102 is connected to a line 105 extending from a power feeding port 104 connected to the first antenna 101. A gap is interposed between the second antenna 102 and third antenna 103 wherein the second antenna 102 is capacitively coupled to the third antenna 103 on the substrate 100 with no antenna switch being provided.

22 Claims, 27 Drawing Sheets

(b)

(a)

(b)

(a)

(b)

(a)

ANTENNA DEVICE AND WIRELESS COMMUNICATION APPARATUS USING SAME

BACKGROUND OF THE INVENTION

1. Field of the Invention

The present invention relates to an antenna device and more particularly to the antenna device that can operate in a plurality of frequency bands and a wireless communication device using the antenna device.

2. Description of the Related Art

In recent years, a wireless communication apparatus such as a mobile phone or a like has become widespread and various bands of frequencies are used in communications.

In a recently-available mobile phone called a dual-band, triple-band, or quad-band type mobile phone in particular, one mobile phone is made to operate in a plurality of transmitting and receiving frequency bands.

In such a circumstance, hurried development of an antenna device making up antenna circuits embedded in a mobile phone or a like being capable of operating in the plurality of transmitting and receiving frequency bands described above is needed.

It is thus necessary that, in order to respond to needs for further miniaturization of a wireless communication apparatus such as a mobile phone and for operations in a multi-band of frequencies, despite a tendency of an increase in antenna components, the antenna device can achieve its miniaturization and can have high performance.

An example of such a conventional antenna device embedded in one mobile phone being a wireless communication apparatus which uses a plurality of transmitting and receiving frequency bands is disclosed in Patent Reference 1 (Japanese Patent Application Laid-open No. 2004-88218) in which antennas each operating in every different transmitting and receiving band to be used is embedded in an antenna device of a mobile phone and these antennas are connected to one power feeding port in a branched manner to be mounted in a substrate (this technology is referred to as a conventional example).

However, such a conventional antenna device has problems. That is, the conventional antenna device generally does not use mutually and electromagnetically each of components making up the antenna device, in order words, the conventional antenna device arranges antennas in a manner being apart from one another so as to decrease mutual interference among antennas. Furthermore, in the conventional antenna device, power is fed to every antenna corresponding to each transmitting and receiving frequency band and, therefore, antenna switches are required, which causes the antenna circuit on the circuit to occupy space in the antenna device area.

There are conventional antenna devices in which one antenna is configured to handle signals in the IDCS band (1700 MHz), PCS band (1800 MHz), GSM band (900 MHz), and UMTS band (2200 MHz) in a shared manner to allot transmitting and receiving signals in the above GSM and UMTS bands to each transmitting and receiving circuit by using antenna switches.

However, the antenna switches used in the conventional antenna device to allot signals have complicated configurations and large insertion loss occurs in the UMTS band of high frequencies in particular.

Moreover, the above conventional antenna device presents another problem in that signals in all the DCS, PCS, GMC, and UMTS bands are handled in a shared manner using a single power feeding port, a deviation occurs in diffusion of radio waves, causing non-uniformity of directivity of vertically polarized waves in the antenna corresponding to each of the transmitting and receiving frequency bands.

Moreover, when these antennas are applied to a wireless communication apparatus such as a mobile phone, antenna switches to switch the transmitting and receiving frequency band are required, which occupies space for the antenna device on the substrate and, as a result, a degree of freedom of arrangement (layout) of the antenna in a cabinet of the wireless communication apparatus is decreased, which makes it difficult to miniaturize the wireless communication apparatus such as a mobile phone.

Furthermore, the conventional antenna device also has another problem in that, though easy impedance matching in a plurality of transmitting and receiving frequency bands is expected by mounting a main antenna on a substrate without using an antenna switch and by making a sub-antenna be branched from an intermediate position of the main antenna, problems of being unable to maintain non-directivity of vertically polarized waves of an antenna corresponding to each transmitting and receiving frequency band in a triple band including the GSM, DCS, and PCS bands and in a quad band including the GSM, DCS, PCS, and UMTS bands and being unable to stop a decrease in insertion loss and of being unable to save space remain still unsolved.

SUMMARY OF THE INVENTION

In view of the above, it is an object of the present invention to provide an antenna device which is capable of operating in a wider band of frequencies (in a plurality of transmitting and receiving frequency bands), achieving an excellent gain, maintaining non-directivity of vertically polarized waves in each of the transmitting and receiving frequency bands, and saving space.

The present inventor of the present invention has made various studies and researches of the antenna device to achieve integration of smaller antenna components and to realize electromagnetic mutual use of these smaller antenna components.

That is, to solve the above problems, according to the antenna device invented by the inventor, the antenna device includes a substrate, a first antenna mounted on said substrate, a second antenna mounted on the substrate and, a third antenna mounted on the substrate wherein each of the first, second, and third antennas operates in first, second, and third transmitting and receiving frequency bands each being different from one another and the first and second antennas are connected to a transmitting and receiving circuit via the same power feeding port (first power feeding port) and the third antenna is connected to the transmitting and receiving circuit via a second power feeding port being different from the first power feeding port and a gap is interposed between the first or second antenna and the third antenna on the substrate in a manner in which electrostatic capacity occurs between the first or second antenna and the third antenna that can be mutually used electromagnetically.

Also, the antenna device including a substrate, a first antenna mounted on said substrate, a second antenna mounted on the substrate, and a third antenna mounted on the substrate, wherein each of the first, second, and third antennas operates in each of transmitting and receiving frequency bands being different from one another and the first and second antennas are connected to a transmitting and receiving circuit via the same power feeding port (first power feeding port) and the third antenna is connected to the transmitting and receiving circuit via a second power feeding port being different from the first power feeding port and the first or second antenna and the third antenna are mounted on the substrate with a gap interposed between the first or second antenna and the third antenna so that the first or second antenna is electrostatically and capacitively coupled to the third antenna and, as a result, a resonant current from the second antenna and a resonant current from the third antenna flow between the fast power feeding port of the second antenna and the second power feeding port of the third antenna.

By configuring as above, space needed antenna itself and among antennas for every transmitting and receiving frequency band can be used electromagnetically and mutually, which allows the antenna to operate in a wider band (a plurality of transmitting and receiving frequency bands) and to obtain excellent gain and maintain non-directivity of vertically polarized waves in each of the transmitting and receiving bands, in a space-saving manner.

In particular, the antenna device of the present invention provides flexibility that leads to easy realization of operations in wider band (a plurality of transmitting and receiving frequency band) of frequencies to be used. The above configurations allow the antenna device to obtain excellent gain in a wide band (in a plurality of transmitting and receiving frequency bands) and to achieve non-directivity of vertically polarized waves.

Moreover, the above configurations allow the antenna device to obtain excellent gain and achieve non-directivity of vertically polarized waves in each of the above transmitting and receiving frequency bands.

According to the configurations as above, the second antenna is connected to the transmitting and receiving circuit via the same power feeding port connected to the first antenna and the third antenna is connected to the transmitting and receiving circuit via the power feeding port being different from the above power feeding port connected to the first antenna and the first or second antenna and the third antenna are mounted on the substrate with the gap interposed between the first or second antenna and the third antenna.

Therefore, by adjusting an interval of the gap, the first or second antenna can be electrostatically and capacitively coupled to the third antenna, thus enabling the electromagnetic and mutual use of the gap, thereby improving impedance matching among the first, second, and third antenna and, as a result, the antenna can operate in each wide band and obtain excellent gain and maintain non-directivity of vertically polarized waves.

Moreover, the gap denotes an interval in which at least electrostatic and capacitive coupling occurs.

However, it is not necessary that both the first and second antennas are electrostatically and capacitively coupled to the third antenna. Minimum requirement is that either of the first antenna or the second antenna is mounted on the substrate with a gap interposed between the first or second antenna and third antenna and is electrostatically and capacitively coupled to the third antenna.

Since the first or second antenna is electrostatically and capacitively coupled to the third antenna, it is preferable that no grounding electrode is provided between the first or second antenna and the third antenna so as not to hinder electromagnetic and mutual use.

Also, according to the configurations as above, the second antenna is connected to the transmitting and receiving circuit via the same power feeding port as used for the first antenna and, therefore, signals transmitted and received by the first antenna and the second antenna can be processed by the same signal processing circuit.

As a result, parts such as antenna switches used to switch a band of frequencies are not required and configurations of the transmitting and receiving circuit can be simplified and space not only for the antenna but also circuits can be saved.

Also, an antenna to be connected to the transmitting and receiving circuit through the first power feeding port can be made up of the chip-type antenna being the first antenna to operate in the GSM band or the pattern antenna being the second antenna to operate in the DCS or PCS band.

Moreover, an antenna to be connected to the transmitting and receiving circuit through the second power feeding port can be made up of the layer-stacked antenna being the third antenna to operate in the UMTS band.

Preferably, the first power feeding port is mounted nearer to one side relative to a center of the substrate and the second power feeding port is mounted nearer to one side being opposite to the one side relative to the center of the substrate.

By configuring as above, the second antenna is electrostatically and capacitively coupled to the third antenna and, as a result, a resonant current from the second antenna and a resonant current from the third antenna flow between the first power feeding port of the second antenna and the second power feeding port of the third antenna.

Since two power feeding ports are arranged so as to be symmetrical to each other with respect to a central line of the substrate in its longitudinal direction, at a distance between the two power feeding ports, a node of an electromagnetic wave having a ¼ waveform in the GMS band or ½ waveform in the DCS, PCS, and UMTS bands is formed, which solves a problem of a null point (drop point of a gain) on the surface of the substrate and which enables the antenna to maintain non-directivity of vertically polarized waves in the GSM, DCS, PCS, and UMTS bands.

Also, the first transmitting and receiving frequency band to be used in said first antenna may be a band of frequencies being lower than frequencies to be used in the second and third antennas and the first antenna may be a chip-type antenna including a base body made of at least one of a dielectric material and a magnetic material and a conductor attached to said base body.

By configuring as above, the first antenna that operates in a band of, for example, comparatively low frequencies such as a GSM, that is, in a band of frequencies having comparatively long waveform can be made up of a chip-antenna.

By attaching a conductor pattern to a chip being a dielectric, a wavelength shortening effect is obtained, thereby enabling miniaturization of the antenna device. Owing to this, the antenna can operate in a band of comparatively low frequencies such as a GSM band in a flexible and simple manner and its occupied area in an antenna device on the substrate can be made small.

Also, the second antenna can be configured as a pattern antenna made up of a conductor pattern formed on the substrate. By configuring as above, though the occupied area of the second antenna on the substrate becomes comparatively large, its height on the substrate can be made small, which enables the second antenna and the antenna device to be small in height.

Also, the second transmitting and receiving frequency band to be used in the second antenna may contain transmitting and receiving frequency bands to be used in at least two communication systems being different from one another.

By configuring as above, the second antenna can be used as an antenna that can operate in at least two transmitting and receiving frequencies.

Therefore, the antenna device of the present invention can be used as at least the quad-band type antenna.

For example, a frequency band of the DCS band is near to that of the PCS band and signals in the DCS and PCS bands can be processed by the same transmitting and receiving circuit and, therefore, by configuring the second antenna as the antenna that can operate in the DCS and PCS bands, the antenna device of the present invention can be configured as the quad-band antenna device that can operate in four transmitting and receiving frequency bands including, for example, the GSM, DCS, PCS, and UMTS bands.

Also, the third transmitting and receiving frequency band to be used in the third antenna is a band of frequencies being higher than transmitting and receiving frequencies to be used in the second antenna, wherein the third antenna is a chip-type antenna including a base body made of at least one of a dielectric material and a magnetic material and conductors attached to the base body.

By configuring as above, in the same manner as the chip antenna is used in the GSM band, the third antenna that operates in a band of comparatively high frequencies such as a UMTS band can be configured as a chip-type antenna and, therefore, the third antenna of the present invention can be made small in size and can operate in a band of comparatively high frequencies such as a UMTS in a flexible and simple manner and its occupied area on the substrate can be made small.

Also, preferably, the third antenna is a layer-stacked antenna obtained by arranging the conductors in the base body.

By configuring as above, an effective dielectric constant of the third antenna is made high and, as a result, a volume of the antenna base body can be made smaller and can be miniaturized more when compared with the case in which the third antenna device is configured as the chip-type antenna.

Thus, the antenna device of the present invention can be configured as a surface mounting antenna device in which the first, second, and third antennas are mounted on the surface of the base.

Preferably, the second antenna and the third antenna are mounted on the substrate with the gap interposed between the second and third antennas.

By configuring as above, the second antenna being the pattern antenna operating in the DCS and PCS bands can be electrostatically and capacitively coupled to the third antenna being the layer-stacked antenna operating in the UMTS band.

Also, the first antenna may be mounted on a main surface of the substrate and the second antenna may be mounted on a rear of the main surface of the substrate and may be connected to the first antenna mounted on the main surface via a through hole electrode connected to a line to connect the first antenna to the first power feeding port.

Also, the first antenna is mounted on the main surface of the substrate and the second antenna is mounted on the rear of the main surface with the substrate being interposed between the first and second antennas so that the first antenna faces the second antenna and so that the second antenna is electrostatically and capacitively coupled to the first antenna and so that the second antenna is connected to the first power feeding port.

By configuring as above, the second antenna may be mounted on a rear of the main surface of the substrate and is not connected to the first antenna mounted on the main surface via a through hole electrode connected to a line to connect the first antenna to the first power feeding port and, therefore, a process of formation of a hole on the substrate is not required which simplifies manufacturing processes.

Also, preferably, no grounding electrode is provided between the first and second antennas and the third antenna.

By configuring as above, by electrostatically and capacitively coupling the first and second antennas and the third antenna, a resonant current is made to flow and, therefore, preferably no grounding electrode is provided between the first and second antenna and the third antenna.

Since a distance between the antenna and the grounding electrode is large, capacitive coupling between the antenna and the grounding electrode is small, which causes the resonant current to be made small. As a result, radiation efficiency of radio waves radiated from the antenna is improved, however, it is made difficult to maintain non-directivity and to respond to a wider band of transmitting and receiving frequencies.

Furthermore, according to the present invention, the antenna device having the configurations described above is embedded in a wireless communication apparatus.

Owing to this, it is made possible to save space for the antenna device embedded in the wireless communication apparatus and to increase a degree of freedom of arrangement (layout) of the antenna device in the wireless communication apparatus and to achieve the miniaturization of the wireless communication apparatus.

With the above configuration, it is made possible to realize a small-sized antenna device which can operate in a wide band (in a plurality of transmitting and receiving frequency bands) and obtain excellent gain in every band of transmitting and receiving frequencies and maintain non-directivity of vertically polarized waves.

Therefore, when the antenna device is applied to a wireless communication apparatus such as a mobile phone, space for the embedded circuit can be saved, thus increasing a degree of freedom of arrangement (layout) which facilitate miniaturization of the wireless communication apparatus.

Also, according to the present invention, when signals in the GSM band or UMTS band are switched, the transmitting and receiving circuit for signals in the GSM band is separated from the transmitting and receiving circuit for the signals in the UMTS band and, therefore, no complicated antenna switches used to switch the transmitting and receiving band are required, thereby enabling a decrease in insertion loss.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

Figure 1:
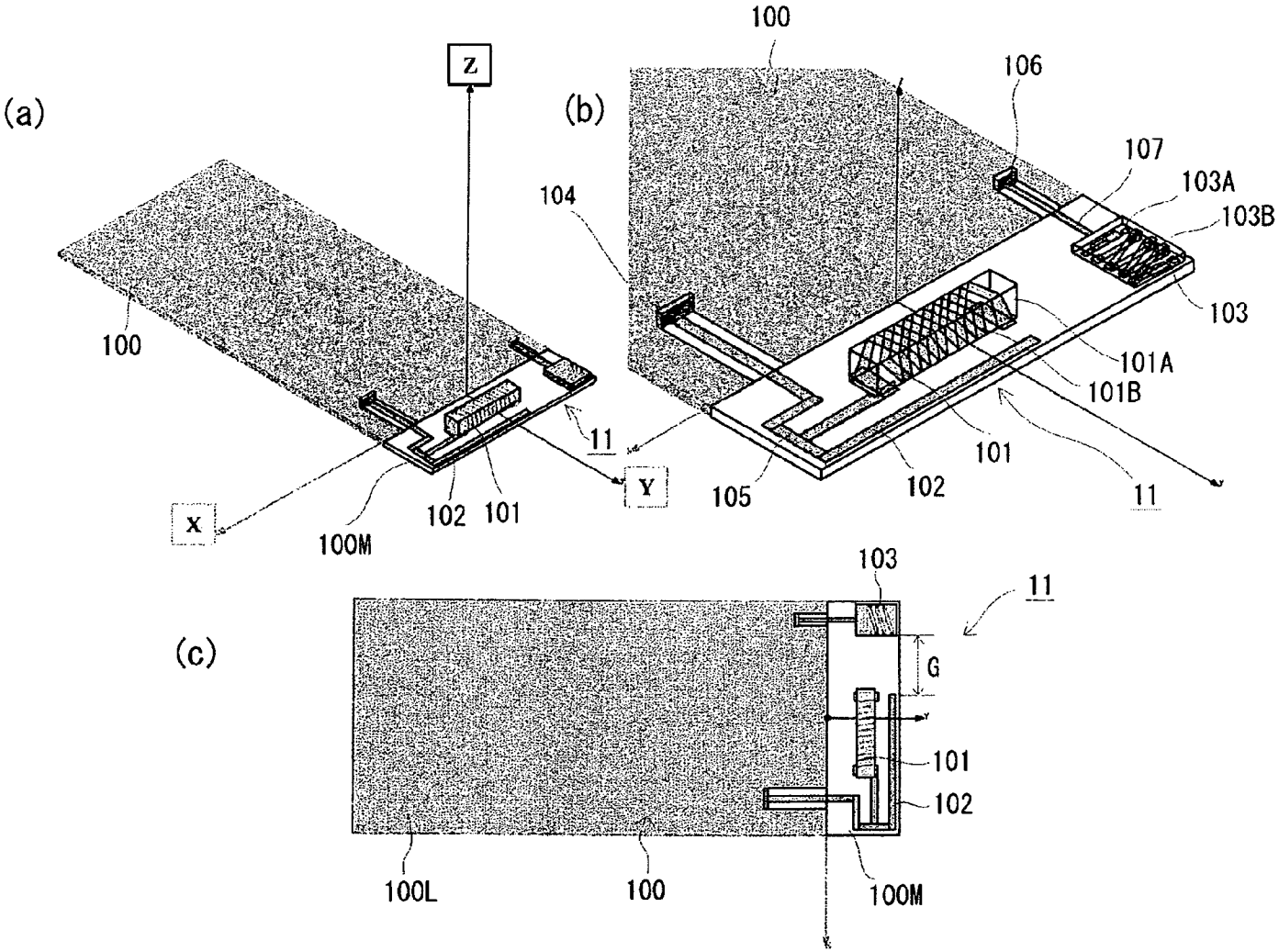
FIG. 1 is a diagram showing basic configurations of an antenna device according to the first example of the first embodiment of the present invention and FIG. 1(*a*) is a perspective view illustrating an entire configuration of the antenna device of the first example and FIG. 1(*b*) is an expanded perspective view illustrating main portions of the antenna device and FIG. 1(*c*) is a plan view illustrating an entire configuration of the antenna device.

Here, by referring to drawings, an antenna device of embodiments of the present invention is described in detail. The first embodiment of the present invention is explained by referring to FIGS. 1 to 15. FIG. 1 is a diagram showing basic configurations of the first example of the antenna device according to the first embodiment of the present invention and FIG. 1(*a*) is a perspective view illustrating an entire configuration of the antenna device of the first example and FIG. 1(*b*) is an expanded perspective view illustrating main portions of the antenna device and FIG. 1(*c*) is a plan view illustrating an entire configuration of the antenna device.

As shown in FIGS. 1(*a*), 1(*b*), and 1(*c*), the antenna device 11 of the first embodiment includes a substrate 100, the first antenna 101 and second antenna 102, and third antenna 103, all being mounted on a substrate 100.

Each of these first, second, and third antennas operates in transmitting and receiving frequency bands each being different from one another. More specifically, the first antenna 101 operates in a GSM band (900 MHz band), the second antenna 102 in a DCS band (1700 MHz band) and a PCS band (1800 MHz band), and the third antenna 103 in an UMTS band (2200 MHz band), thereby achieving the quad-band type antenna device 11.

Thus, the first antenna 101 operates in the transmitting and receiving frequency band of frequencies being lower than those in the DCS band and the PCS band applied to the second antenna and than the UMTS band applied to the third antenna 103. The second antenna 102 operates in two transmitting and receiving bands of the DCS band and PCS band which are different from each other but are near each other. Moreover, the third antenna 103 operates in the UMTS band of frequencies being higher than those in the DCS and PCS bands applied to the second antenna.

Moreover, the antenna device 11 of the embodiment is configured so that signals transmitted and received in the GSM band applied to the first antenna 101 and signals transmitted and received in the DCS and PCS bands applied to the second antenna 102 are processed by the same transmitting and receiving circuit.

Here, as shown in FIGS. 1(*a*), 1(*b*), and 1(*c*), the first antenna 101 includes a base body 101A made up of a dielectric or magnetic substance and a conductor (electrode) 101B mounted in the base body 100A and is constructed as a chip antenna mounted on a surface of the substrate 100. The second antenna 102 is constructed as a pattern antenna made up of a conductor pattern formed on the substrate 100. The third antenna 103 is constructed, by stacking conductors 103B in the base body 103A made up of a dielectric or magnetic substance, as a layer-stacked antenna mounted on the surface of the substrate 100 (this is described later in detail by referring to FIG. 21[*b*]) and FIGS. 22 and 23).

That is, the antenna device 11 of the first embodiment is configured as a surface-mounted type antenna in which the chip antenna, pattern antenna, and layer-stacked antenna are arranged on the surface of the substrate 100.

In the antenna device 11 of the embodiment, the pattern antenna making up the second antenna 102 is so arranged as to branch off from a line 105 which connects the chip antenna making up the first antenna 101 to a power feeding port 104.

The second antenna 102, lines 105 and 107 are formed by conductor patterns and, therefore, can be formed using a screen printing method. Furthermore, the second antenna 102 is placed with a gap G being interposed between the second antenna 102 and the third antenna 103. That is, the second antenna 102 is coupled capacitively to the third antenna 103 with the gap G being interposed between the second antenna 102 and the third antenna 103. Therefore, the gap G here denotes an interval in which at least electrostatic capacity coupling is assumed simply.

In the embodiment, it is assumed that the first antenna 101 also is coupled electrostatically and capacitively to the third antenna 103, however, it is not necessary that both the first antenna 101 and second antenna 102 are coupled capacitively to the third antenna 103.

Minimum requirements are that the first antenna 101, second antenna 102, and third antenna 103 are arranged so that there is a gap between either of the first antenna 101 or second antenna 102 and the third antenna 103 so that the power feeding port 104 of the second antenna 102 is electrostatically and capacitively coupled to the power feeding port 106 of the third antenna 103 and, as a result, a resonant current from the second antenna 102 and a resonant current from the third antenna 103 flow between the first power feeding port 104 for the second antenna 102 and the second power feeding port 106 for the third antenna 103.

Configurations of the antenna device 11 of the embodiment are described more specifically by referring to FIGS. 1(*a*), 1(*b*), and 1(*c*). The antenna device 11 includes an antenna mounted region 100M and a region neighboring to the antenna mounted region 100M containing an antenna non-mounting region 100L serving as an antenna grounding electrode (antenna conductors). The substrate 100 is a PCB (Printed Circuit Board) made up of glass-like epoxy resin being 40 mm in an X (width) direction, 90 mm in a Y (length) direction, and 2 mm in a Z (thickness) direction, or a like and is embedded in a mobile phone as a communication apparatus of the embodiment of the present invention described later.

Hereinafter, directions of arrangements of other components are described by expressing the width direction of the substrate 100 as the X direction, its length direction as the Y direction, and its thickness as the Z direction. On side of the substrate 100 in its length (Y) direction, the antenna mounted region 100M is formed 10 mm in its length (Y) direction and in all the width (X) direction.

Moreover, a remaining portion of the substrate 100 is a region where other circuits of the mobile phone including transmitting and receiving circuits connected to the first antenna 101, second antenna 102, and third antenna 103 and is hereinafter referred to as the antenna no-mounting region 100L.

The first antenna 101 is constructed by winding conductors (electrodes) 101B around surfaces of the base body 101A of a cuboid shape made of a dielectric material and, as the first antenna 101, a chip (ultra-small piece) antenna, for example, being 15 mm in length and 3 mm in height is surface-mounted in an approximately central portion of the antenna mounted region 100M in a manner in which the length direction of the chip antenna is parallel to the X direction (in the width direction of the substrate 100).

The first antenna 101 is arranged on the substrate 100 in a manner in which its end in the X direction passes slightly by a center of the antenna mounted region 100M and its end in the Y direction is located approximately in the center of the antenna mounted region 100M.

The second antenna 102 is the pattern antenna made up of conductor patterns formed so as to be parallel to the first antenna 101 with a specified interval sandwiched between the first antenna 101 and second antenna 102 and so as to be about 25 mm in length and, as in the case of the first antenna 101, is arranged on the substrate 100 in a manner in which its end in the X direction passes slightly by a center of the antenna mounted region 100M and its end in the Y direction is located in the farthest end of the antenna mounted region 100M.

The pattern antenna making up the second antenna 102, as described above, is so arranged as to branch off from the line 105 which connects the chip antenna making up the first antenna 101 to the power feeding port 104.

The third antenna 103 is constructed by stacking the conductors 103B in the base body 103A of a shape of a rectangular piece made of a dielectric material and, as the third antenna 103, a chip (ultra-small piece) antenna, for example, being 7 mm in length, 5 mm in width, and 0.7 mm in height, is surface-mounted in a manner in which its length direction is parallel to the Y direction (length direction of the substrate 100) and is surface-mounted in an end portion of the above antenna mounted region 100M on a side opposite to the power feeding port 104 or the line 105 for the first antenna 101 or second antenna 102.

The third antenna 103 is surface-mounted so as to be located in the farthest end of the antenna mounted region 100M in the X direction and about 5 mm far from the antenna non-mounting region 100L in the Y direction.

Additionally, the third antenna 103 is configured so that signals in the UMTS band, which is a transmitting and receiving frequency band applied to the third antenna 103, are processed by a transmitting and receiving circuit being separate and different from the transmitting and receiving circuits used in the first antenna 101 and second antenna 103 and so that the power feeding port 106 connected via the line 107 to the third antenna 103 is placed, in the X direction, on a side opposite to the power feeding port 104 in the antenna non-mounting region 100L.

By configuring as above, the first antenna 101, second antenna 102, and third antenna 103 are arranged so that the gap G between the first antenna 101 or second antenna 102 and the third antenna 103 is about 9 mm in length which causes at least electrostatic capacity coupling to occur.

Figure 2:
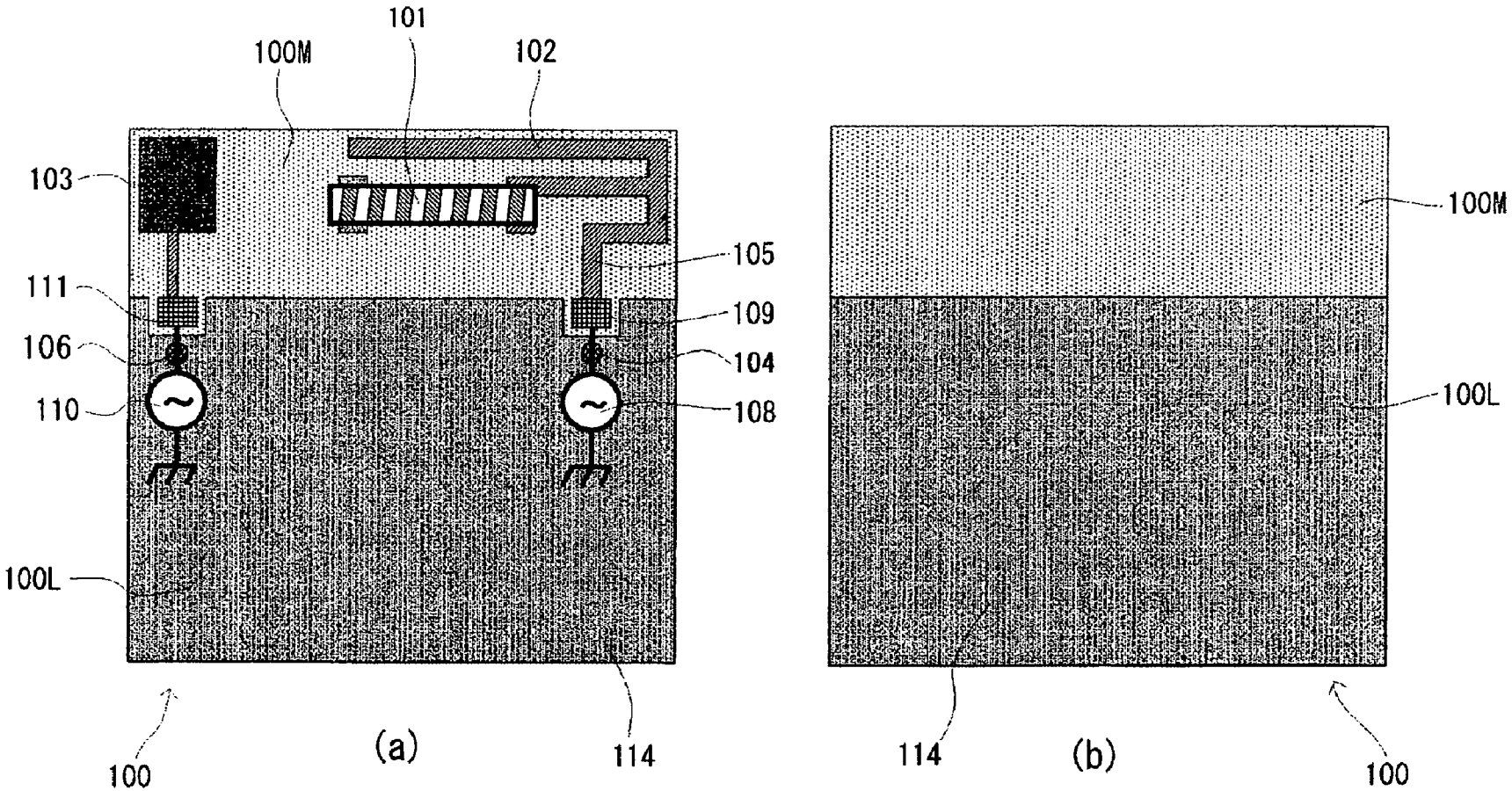
FIG. 2 is a diagram illustrating basic configurations of an antenna circuit in the antenna device shown in FIG. 1 and FIG. 2(*a*) shows a component mounting surface of the substrate and FIG. 2(*b*) shows a rear side of the substrate.

FIG. 2 is a diagram illustrating basic configurations of an antenna circuit in the antenna device 11 shown in FIG. 1 and FIG. 2(*a*) shows a component mounting surface of the substrate 100 and FIG. 2(*b*) shows a rear side of the substrate 100.

As shown in FIG. 2(*a*) and FIG. 2(*b*), the first antenna 101 and second antenna 102 are connected to a transmitting and receiving circuit section (signal processing circuit) 108 through the line 105 made up of the conductor patterns and an impedance matching circuit 109 is mounted between the line 105 and the transmitting and receiving circuit section (signal processing circuit) 108.

The third antenna 103 is connected to a transmitting and receiving circuit (signal processing circuit) 110 through the line 107 made up of conductor patterns and an impedance matching circuit 111 is mounted between the line 107 and the transmitting and receiving circuit section (signal processing circuit) 111.

By configuring as above, signals in the GMS band, which is the transmitting and receiving frequency band applied to the first antenna 101, and signals in the DCS/PCS bands, which are the transmitting and receiving frequency bands applied to the second antenna 102, are processed by the same transmitting and receiving circuit 108 and signals in the UMTS band, which is the transmitting and receiving frequency band applied to the third antenna 103, are processed in a transmitting and receiving circuit 110 being separate and different from the transmitting and receiving circuit 108 used in the first antenna 101 and second antenna 103.

Moreover, use of the power feeding line 105 is shared by the first antenna 101 and second antenna 102 between the power feeding line 105 and the transmitting and receiving circuit 108 is performed by the same impedance matching circuit 109, for the third antenna 103 and the transmitting and receiving circuit 110 is performed by the impedance matching circuit 111 being separate and different from the impedance matching circuit 109 used in the first antenna 101 and second antenna 102.

Next, actions and effects of the antenna device 11 of the embodiment are described by comparing with those in an antenna device used as a comparison example. In order to verify advantages of the antenna device 11 of the present invention, the inventor fabricated an antenna device which did not have the third antenna being an essential component of the antenna device 11 of the present invention.

Figure 3:
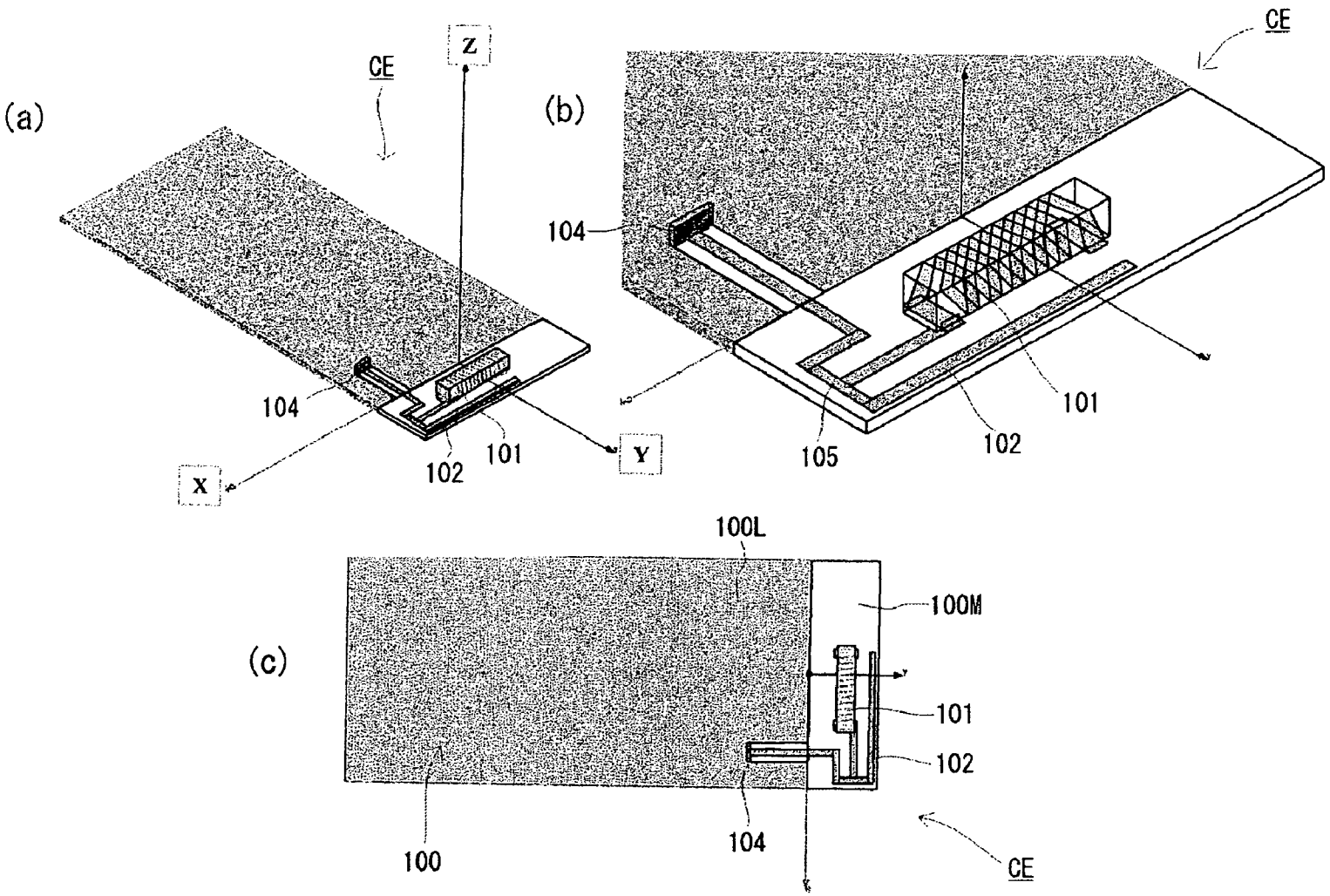
FIG. 3 is a diagram illustrating basic configurations of an antenna device used as a comparison example and FIG. 3(*a*) is a perspective view showing its entire configuration and FIG. 3(*b*) is an expanded perspective view of its main portion and FIG. 3(*c*) is a plan view illustrating its entire configuration.

FIG. 3 is a diagram illustrating basic configurations of the antenna device used as a comparison example and FIG. 3(*a*) is a perspective view showing its entire configuration and FIG. 3(*b*) is an expanded perspective view of its main portion and FIG. 3(*c*) is a plan view illustrating its entire configuration.

Figure 4:
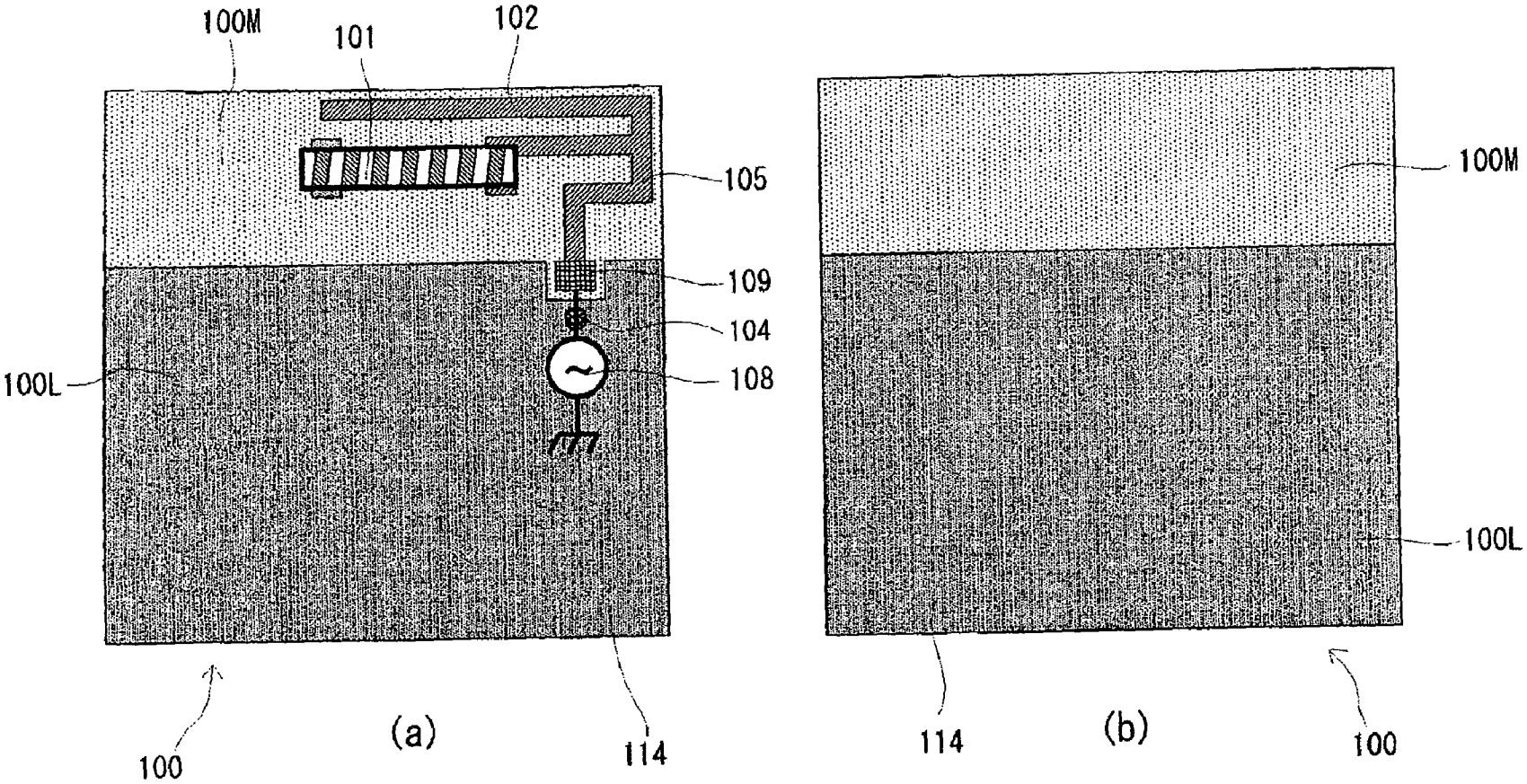
FIG. 4 is a diagram showing basic configurations of an antenna circuit employed in the antenna device shown in FIG. 3 and FIG. 4(*a*) is a diagram showing an antenna mounting main surface side of its substrate and FIG. 4(*b*) is a diagram showing a rear side of the substrate.

FIG. 4 is a diagram showing basic configurations of an antenna circuit employed in the antenna device shown in FIG. 3 and FIG. 4(*a*) is a diagram showing an antenna mounting main surface side of its substrate and FIG. 4(*b*) is a diagram showing a rear side of the substrate.

The antenna device CE used as the comparison example, as shown in FIGS. 3(*a*), 3(*b*), and 3(*c*) has the same configurations as the antenna device 11 of the present invention except that the antenna device CE has no third antenna employed in the embodiment of the present invention.

The antenna device CE includes a substrate 100, a first antenna 101 and a second antenna 102, both being mounted on the substrate 100 that serves as a triple-band antenna device in which the first antenna 101 operates in the GSM band of transmitting and receiving frequencies and the second antenna 102 operates in the DCS and PCS bands of transmitting and receiving frequencies.

Configurations of the antenna device CE shown in FIGS. 4(*a*) and 4(*b*) are the same as the antenna device 11 of the present invention in that signals in the GSM band of transmitting and receiving frequencies applied to the first antenna 101 and signals in the DCS and PCS bands of transmitting and receiving frequencies applied to the second antenna 102 are processed by the same transmitting circuit and in that a pattern antenna making up the second antenna 102 is connected to a line 105 to connect a chip antenna making up the first antenna 101 to a power feeding port 104.

However, the antenna device CE has no third antenna and, therefore, unlike in the antenna device 11 of the present invention, there is no configuration in which the third antenna 103 is mounted on the substrate 100 with the gap G, in which at least electrostatic capacity coupling occurs, being interposed between the third antenna 103 and the first antenna 101 and second antenna 102.

However, remaining configurations of the antenna device CE used as the comparison example are the same in that, for example, dimensions and materials for the substrate 100, antenna non-mounting region 100L, first antenna 101, and second antenna 102, or a like are the same as those of the antenna device 11 of the present invention.

FIGS. 5 to 8 are diagrams showing performance of the antenna device CE used as the comparison example and FIGS. 9 to 14 are diagrams showing performance of the antenna device 11 of the embodiment of the present invention. First, performance of the antenna device CE used as the comparison example is described by referring to FIGS. 5 to 8.

Figure 5:
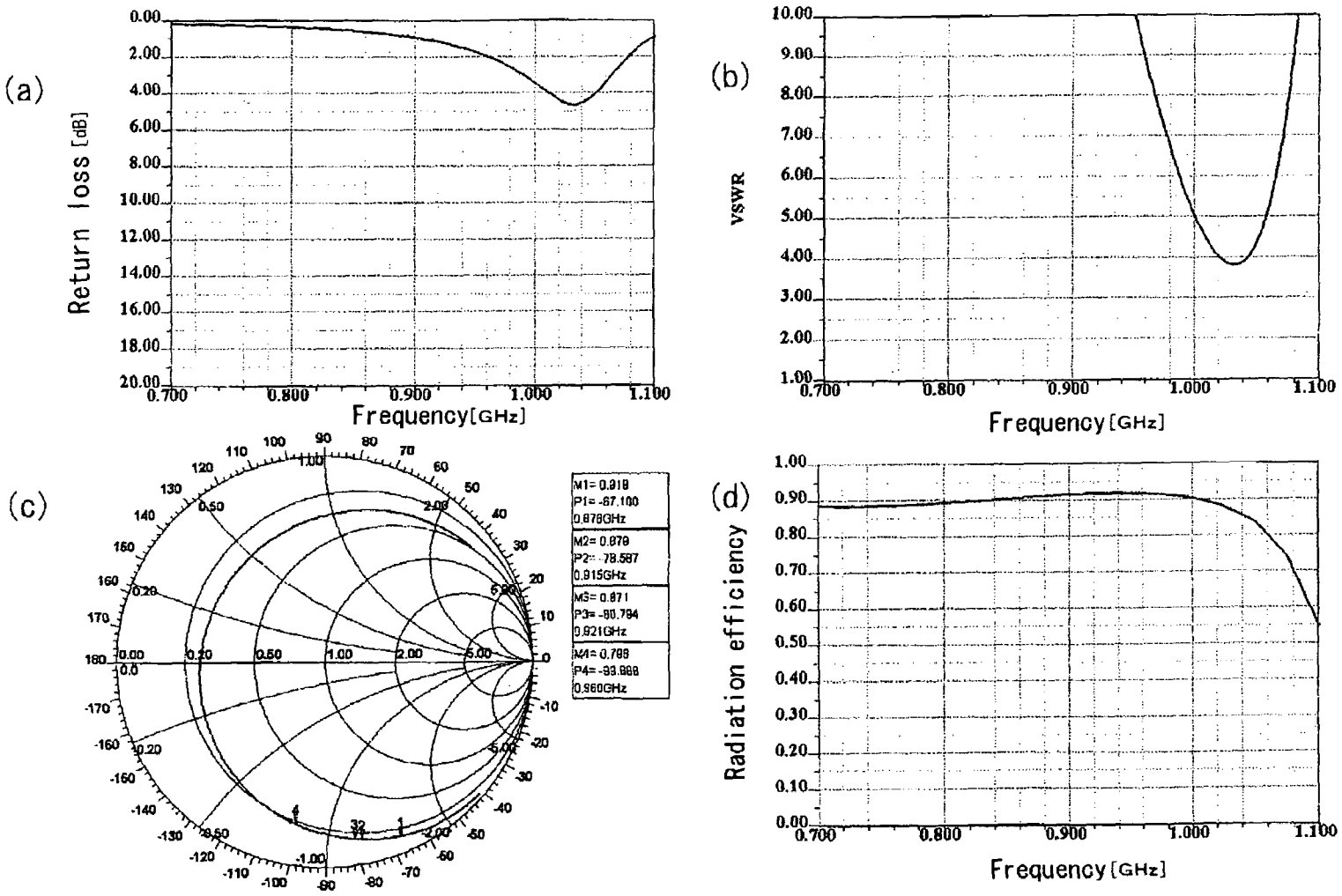
FIG. 5 is a diagram showing antenna properties of the antenna device used as the comparison example in the GSM band.
Figure 6:
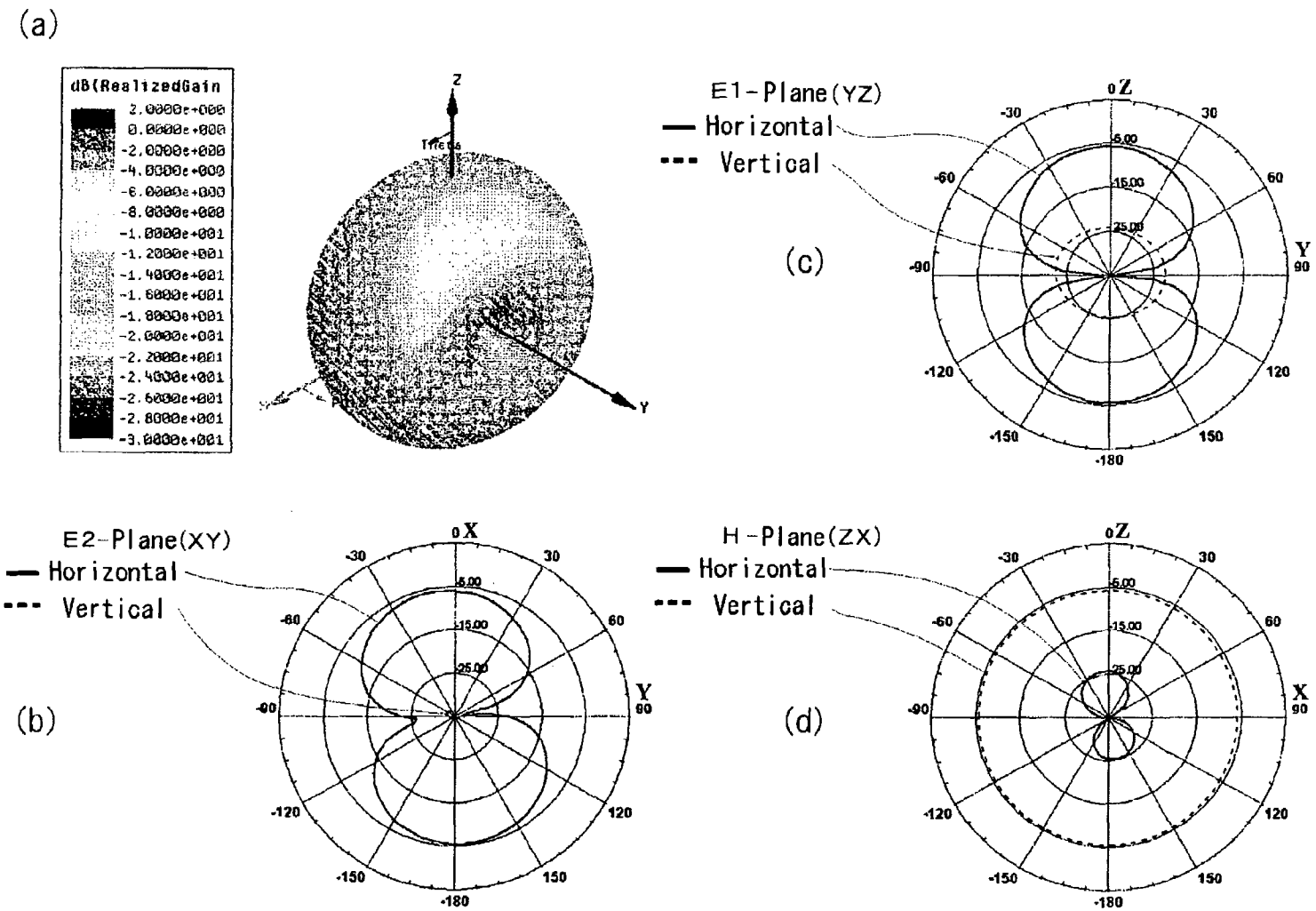
FIG. 6 is a diagram showing antenna properties of the antenna device used as the comparison example in the GSM band.

FIGS. 5 and 6 are diagrams showing antenna properties of the antenna device CE operating in the GSM band.

FIG. 5(*a*) shows data obtained by using an "s-parameter" of the antenna device CE which indicates how much transmitting power of an antenna is reflected and its antenna properties are represented as return loss relative to a frequency (GHz) in the GSM band occurring on the power feeding port side.

This suggests that, when a value [dB] on an ordinate is the smaller, a voltage property being the nearer to a level at power feeding level of 50Ω can be obtained and, therefore, this is one of data blocks indicating an impedance matching property obtained at 50Ω.

Moreover, FIG. 5(*b*) shows data obtained by converting the above "s-parameter" into a voltage standing wave ratio (VSWR) which is a value representing a degree of return of transmitting power applied to an antenna. This shows that, when the VSWR value on the ordinate is the smaller (near to 1), applied power is transmitted the more effectively with less return and, therefore, the more excellent antenna properties are obtained. As shown in FIG. 5(*b*), the VSWR value relative to a frequency is plotted.

In the data shown in FIG. 5(*b*), a point where a curve of a graph becomes near to 1 exists in the neighborhood (1040 MHz) of the GSM band (900 MHz).

FIG. 5(*c*) is a Smith chart showing an impedance matching property of the antenna device CE between the first antenna 101 and the power feeding line, both acting as loads. FIG. 5(*d*)

shows data of radiation efficiency of the antenna device CE which indicates how efficiently power applied to an antenna is radiated in space, which is represented as a ratio of radiation efficiency (ordinate) to each frequency (abscissa).

Therefore, this shows that, when a value on the ordinate is the larger (near to 1 [100%]), the radiation efficiency is the higher and antenna properties are the more excellent.

For example, adjustment is made so that radiation efficiency of 0.90 (90%) or more can be obtained in a frequency band to be used. In the example, adjustment is made so that the radiation efficiency of 0.90 (90%) can be obtained in the GSM band (900 MHz) where the value of the VSWR shown in FIG. 5(*b*) becomes smaller (near to 1).

FIG. 6(*a*) is a diagram stereoscopically (three-dimensionally) illustrating antenna directivity out of antenna properties obtained in the GSM band in the antenna device used as the comparison example. FIGS. 6(*b*), 6(*c*), and 6(*d*) are diagrams two-dimensionally showing antenna directivity expressed by curves obtained by plotting the distribution from the central point respectively at cross sections of an X-Y face, Y-Z face, and Z-X face using the X, Y, and Z axes shown in FIG. 6(*a*) as a reference axis.

These drawings show that, when the distribution expressed by the curve from the central point is the larger from the central point toward a direction of a diameter, the directivity is the higher, that is, the gain is the higher and when the distribution is uniform from the central point toward a direction of a diameter and the curve become a circle the more, a drop in the directivity, that is, in the gain is the less and the more uniform.

As the directivity of an antenna to be mounted on a mobile phone, the antenna directivity on the X-Z faces out of the cross-sectional faces is important and it is desirable that the gain becomes maximum at the X-Z face and uniform gain and directivity are obtained at the X-Z face.

This means that the uniform gain and directivity can be obtained in a direction orthogonal to a face of the above-described substrate 100 (Z-X face in FIG. 3).

That is, this means that how much the uniform gain and directivity can be obtained in a short circumferential direction relative to the substrate 100.

In the mobile phone terminal, the substrate 100 for the antenna device is mounted along a longitudinal direction of a cabinet of the thin and long mobile phone terminal and, therefore, how uniform gain and directivity can be obtained in the short circumferential direction of the cabinet of the mobile phone terminal is of importance.

If the uniform gain and directivity in the short circumferential direction of the cabinet of the mobile phone terminal, the directivity can be easily controlled depending on arrangements of metal portions in the cabinet.

As a result, uniformity (non-directivity) of directivity of vertically polarized waves on the Z-X face becomes important. Therefore, it is desirable that the distribution expressed by a curve representing directivity of vertically polarized waves in the Z-X face is uniform from a central point toward a direction of a diameter and that the curve become near to a circle. In the data on the Z-X face shown in FIG. 6(*d*), the curve (Vertical) representing directivity of vertically polarized waves becomes a uniform circle at about −5.00.

Figure 7:
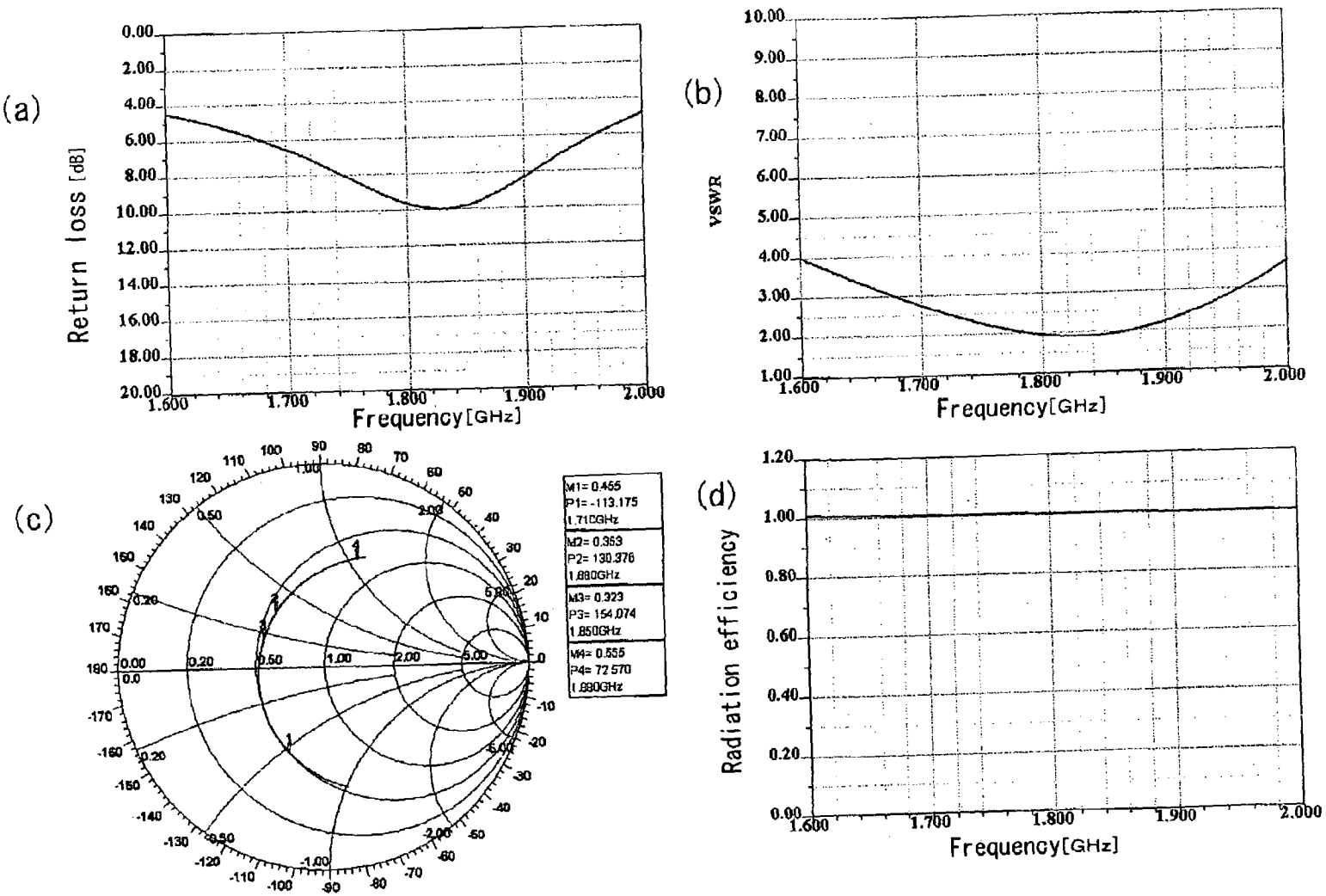
FIG. 7 is a diagram showing antenna properties of the antenna device used as the comparison example in the DCS band and PCS band.
Figure 8:
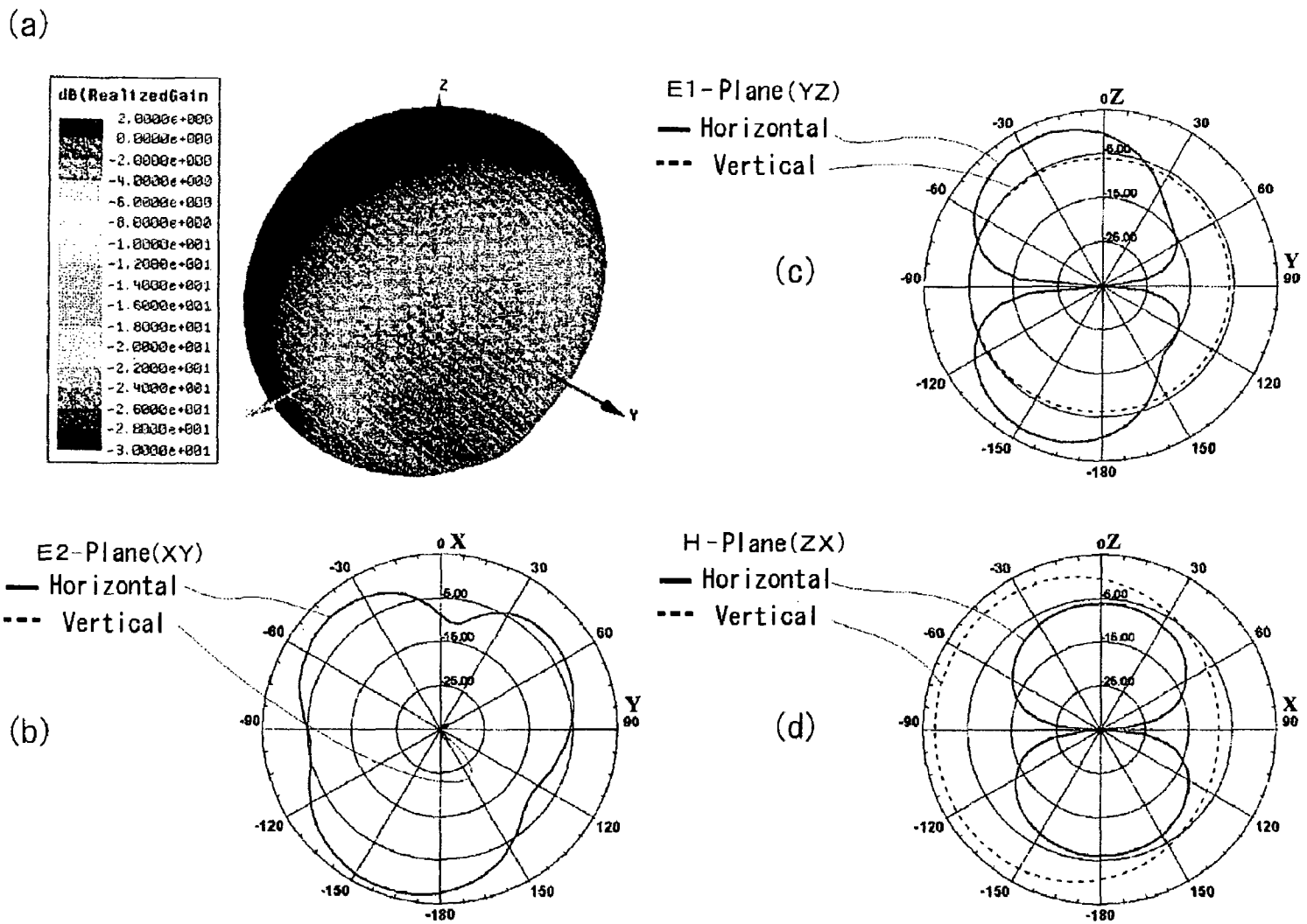
FIG. 8 is a diagram showing antenna properties of the antenna device used as the comparison example in the DCS band and PCS band.

FIGS. 7 and 8 are diagrams showing antenna properties of the antenna device CE used as the comparison example obtained in the DCS and PCS bands. FIG. 7(*a*) shows, as in the case of FIG. 5(*a*), data obtained by using an "s-parameter". The data in FIG. 7(*a*) shows that a value of −6.00 dB is obtained in the bands of 1700 MHz to 2000 MHz and a satisfactory antenna property is realized in bands of 1700 MHz/1800 MHz being frequencies in the DCS and PCS bands to be used.

FIG. 7(*b*) shows data obtained by converting the above s-parameter into the VSWR. FIG. 7(*a*) shows, as in the case of FIG. 5(*b*), data obtained by using an "s-parameter". The data in FIG. 7(*b*) shows that a value of 3.00 dB or less is obtained in the bands of 1700 MHz to 2000 MHz (1960 MHz) and a satisfactory antenna property is realized in bands of 1700 MHz/1800 MHz being frequencies in the DCS and PCS bands to be used.

Also, FIG. 7(*c*) is a so-called Smith chart showing an impedance matching property between the second antenna 102 and the power feeding line, both acting as loads. FIG. 7(*d*), as in the case of FIG. 5(*d*), shows data representing radiation efficiency of an antenna.

The data in FIG. 7(*d*) shows that radiation efficiency of about 100% is obtained in the bands of 1600 MHz to 2000 MHz and a satisfactory radiation efficiency is achieved in bands of 1700 MHz/1800 MHz being frequencies in the DCS and PCS bands to be used.

FIGS. 8(*a*), 8(*b*), 8(*c*), and 8(*d*), as in the case of FIGS. 6(*a*), 6(*b*), 6(*c*), and 6 (*d*), show stereoscopically (three-dimensionally) directivity of the antenna device used as the comparison example out of antenna properties in the DCS and PCS bands.

The data in FIG. 8(*d*) shows the curve representing directivity of vertically polarized waves at a Z-X face is not a uniform circle (true circle) and a drop in gain in the X direction is observed and further the gain in the X direction decreases. In other words, the data shows that a so-called null point (point of the drop in gain) occurs in the X direction.

The inventor of the present invention studied the cause of the occurrence of the null point in the antenna device used as the comparison example and has found that the power feeding port is placed in a manner being deviated on one side (x axis direction side) of the substrate 100 and even if the second antenna 102 (or first antenna 101) is placed in a center of the x axis of the substrate 100, deviated placement of the components including the power feeding port still remain unchanged.

In order to solve the two problems of the occurrence of the null point in the Z-X face and of no operations of the antenna device of the comparison example in the UMTS band, the antenna device 11 of the embodiment of the present invention is realized.

In the antenna device 11 of the embodiment, the third antenna 103 which can operate in the UMTS band is mounted on other end of the substrate 100.

The second antenna 102 (or first antenna 101) and the third antenna 103 are arranged in a manner to be capacitively coupled to each other so that a resonant current from the second antenna 102 (or first antenna 101) and a resonant current from the third antenna 103 flow between the power feeding port 104 and the power feeding port 106.

The power feeding port 106 and the power feeding port 104 are mounted in the x axis direction so as to be symmetrical to each other with respect to a central line of the substrate 100 in the longitudinal direction.

At a distance between the two power feeding ports 104 and 106, a node of an electromagnetic wave having a ¼ waveform in the GMS band or ½ waveform in the DCS, PCS, and UMTS bands is formed, which enables non-directivity of vertically polarized waves in the GSM, DCS, PCS, and UMTS bands to be maintained.

Hereinafter, performance of the antenna device 11 of the embodiment of the present invention is described by referring to FIGS. 9 to 14 and by comparing the performance with that of the antenna device used as the comparison example.

Figure 9:
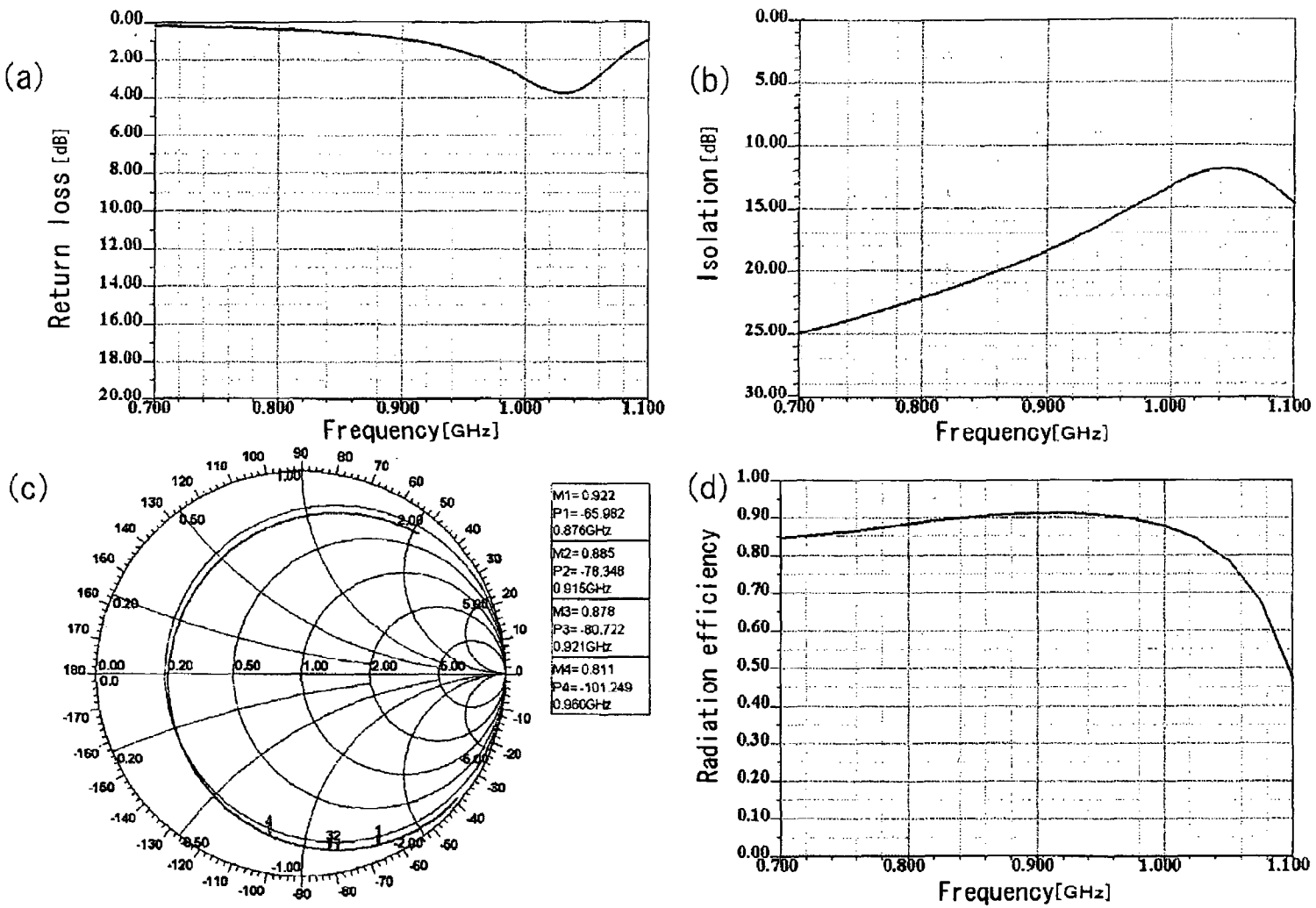
FIG. 9 is a diagram showing antenna properties of an antenna device in the GSM band according to the first example of the first embodiment of the present invention.
Figure 10:
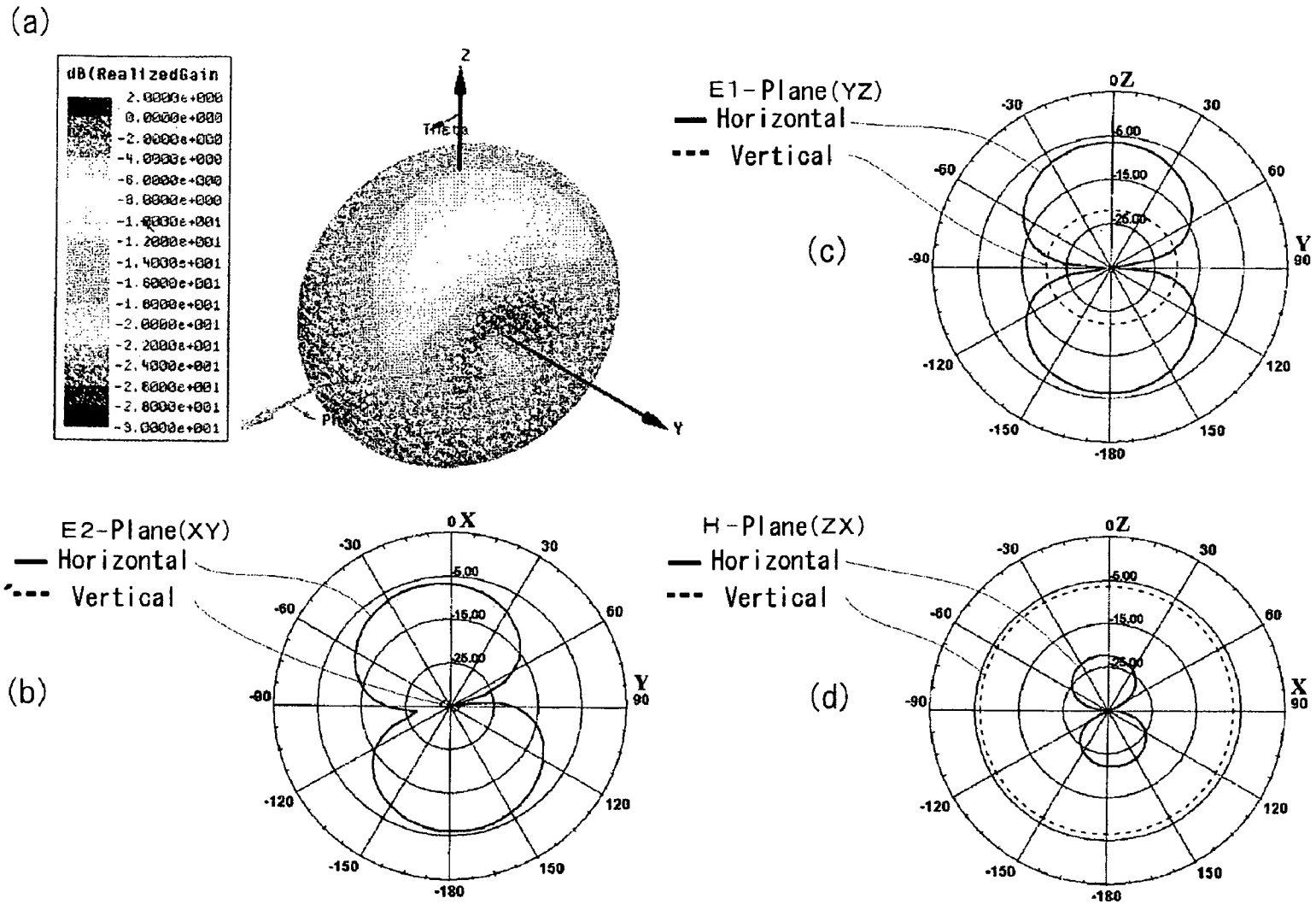
FIG. 10 is a diagram showing antenna properties of the antenna device in the GSM band according to the first example of the first embodiment of the present invention.

FIGS. 9 and 10 are diagrams showing antenna properties of the antenna device 11 of the embodiment in the GSM band.

FIG. 9(*a*) shows, as in the case of the data obtained in the comparison example shown in FIG. 5(*a*), data obtained by using an s-parameter of the antenna device 11 of the embodiment and its antenna properties are represented as return loss relative to a frequency [GHz] in the GSM band occurring on the power feeding port side. In the data of FIG. 9(*a*), approximately the same values as in the comparison example are obtained.

Moreover, FIG. 9(*b*) shows results from the measurement of an isolation property of the antenna device 11, out of the antenna properties of the antenna device 11 in the GSM band, which is expressed as a degree of separation of power from one antenna to another antenna relative to a frequency [GHz].

A target value to judge whether an isolation property is excellent or no is generally 10 dB, however, in the data shown in FIG. 9(*b*), the value is 15.0 dB approximately in the GSM band (900 MHz) and an excellent isolation property is obtained and it is, therefore, confirmed that each of the first antenna 101 and second antenna 102 is electromagnetically separated from the third antenna 103.

FIG. 9(*c*) is a Smith chart showing an impedance matching property between the first antenna 101 and the power feeding line in the antenna device 11, both acting as loads. FIG. 9(*d*) shows, as in the case of the comparison example shown in FIG. 5(*d*), data of radiation efficiency of the antenna device 11. In the data shown in FIG. 9(*d*), up to about 700 MHz to about 1000 MHz, radiation efficiency of about 85% is obtained which shows that a sufficient radiation property is realized at about 900 MHz being a frequency to be used in the GSM band.

FIGS. 10(*a*), 10(*b*), 10(*c*), and 10(*d*) show stereoscopically (three-dimensionally) directivity of the antenna device 11 of the embodiment in the GSM band, out of the antenna properties, in the same way as employed in FIGS. 6(*a*), 6(*b*), 6(*c*), and 6(*d*). The data on the directivity of the antenna device 11 on the Z-X face shown in FIG. 10(*d*) shows that the curve (Vertical) representing directivity of vertically polarized waves is a uniform circle (true circle) and no drop in gain in the X direction is observed and, as a result, uniform directivity, that is, uniform gain is obtained.

Figure 11:
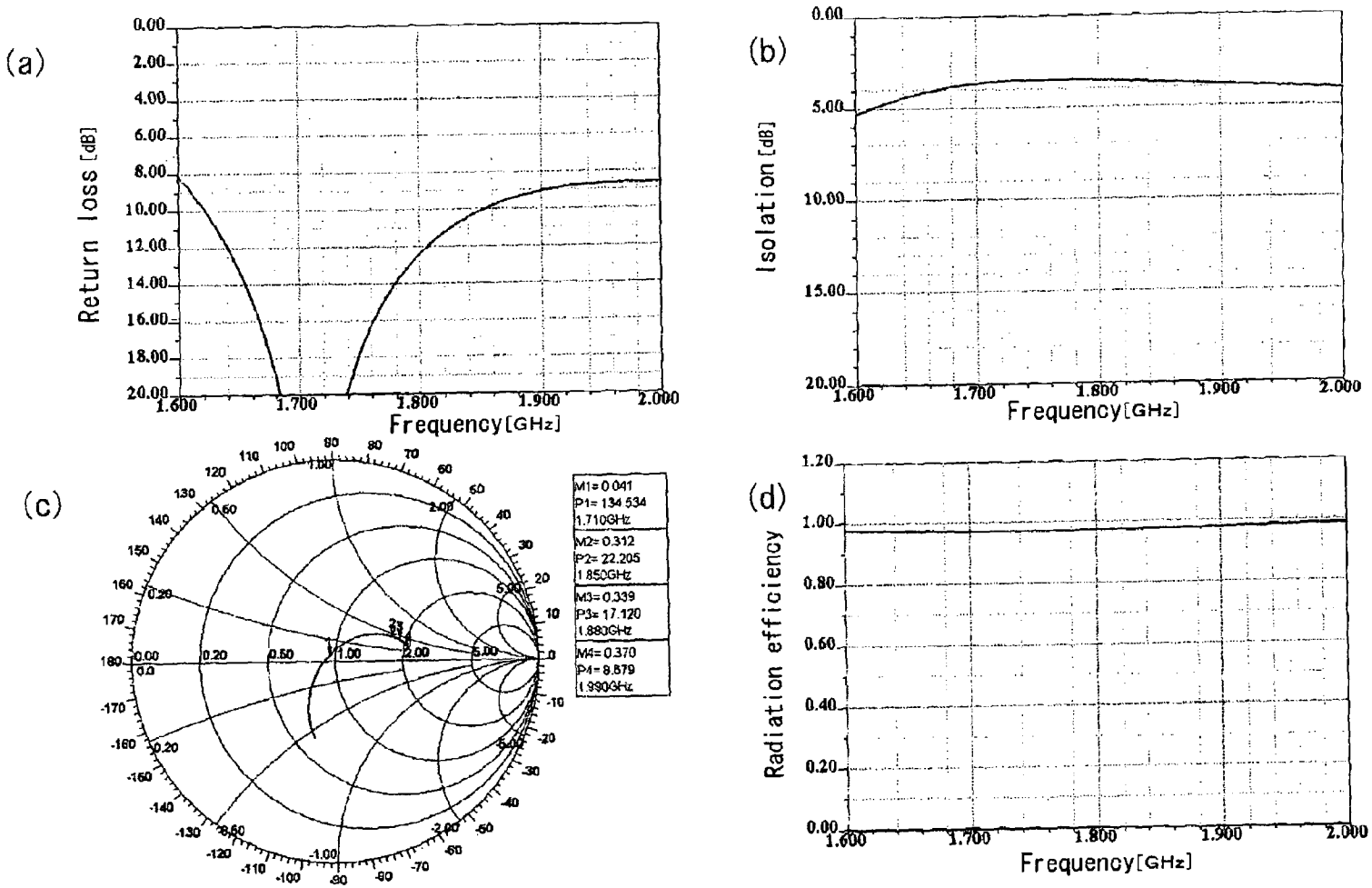
FIG. 11 is a diagram showing antenna properties of the antenna device in the DCS band and PCS band according to the first example of the first embodiment of the present invention.
Figure 12:
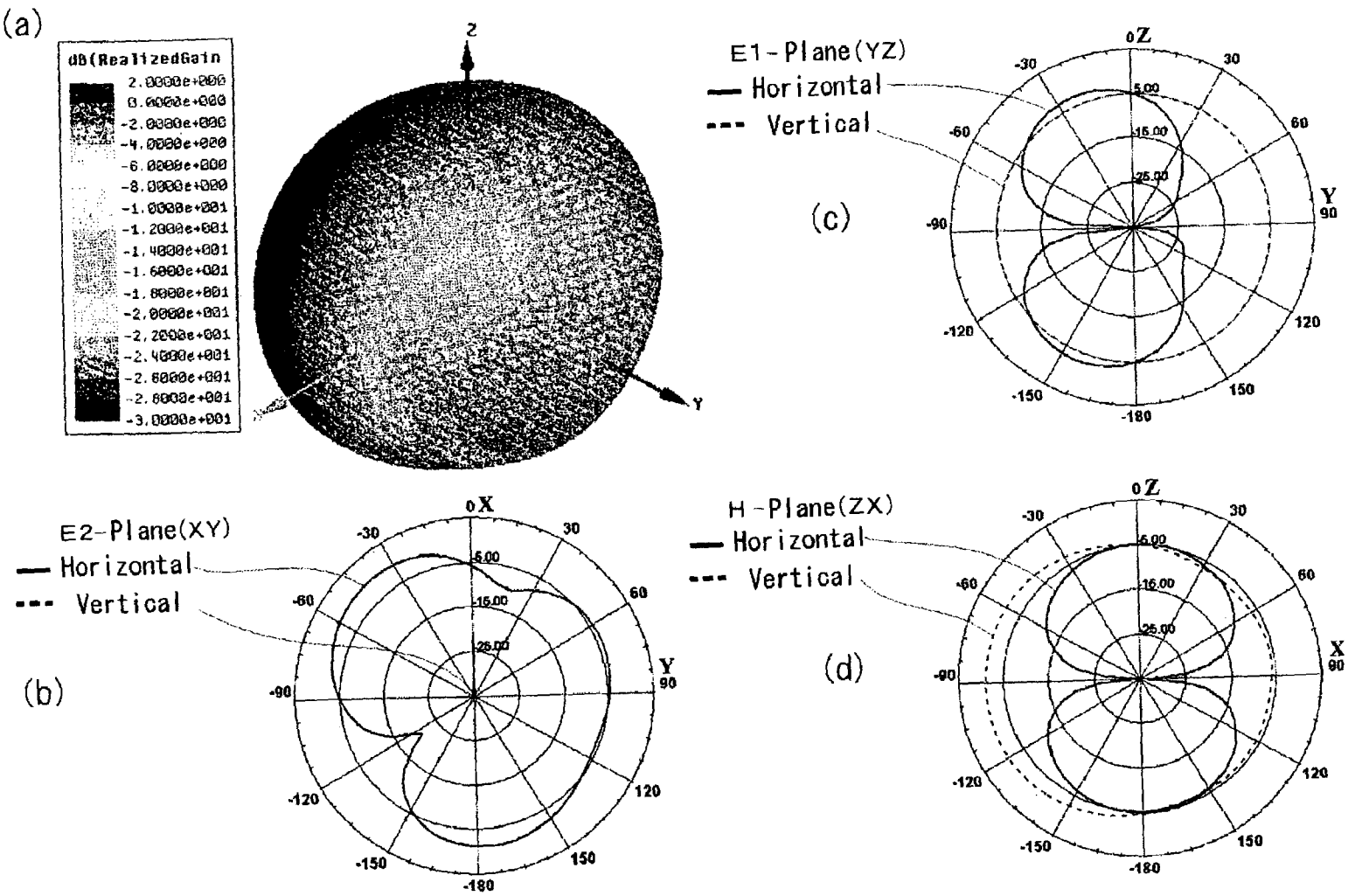
FIG. 12 is a diagram showing antenna properties of the antenna device in the DCS band and PCS band according to the first example of the first embodiment of the present invention.

FIGS. 11 and 12 are diagrams showing antenna properties of the antenna device 11 of the embodiment in the DCS and PCS bands. FIG. 11(*a*) shows, as in the case of the data obtained in the comparison example shown in FIG. 7(*a*), data obtained by using an s-parameter of the antenna device 11 of the embodiment and its antenna properties are represented as return loss relative to a frequency [GHz] in the GSM band occurring on the shared power feeding port 104 side. In the data shown in FIG. 11(*a*), a satisfactory value of 6.00 dB or more (exactly, 8.00 dB or more) is obtained in 1600 MHz to 2000 MHz, which shows that a sufficient antenna property is realized in the bands of 1700 MHz/1800 MHz being frequencies to be applied to the target DCS/PCS bands.

Moreover, FIG. 11(*b*) shows an isolation property of the antenna device 11 of the embodiment, out of the antenna properties of the antenna device 11 in the DCS and PCS bands, which is expressed as a degree of separation of power from one antenna to another antenna relative to a frequency (GHz). The data in FIG. 11(*b*) shows a value being larger than 3.00 is obtained approximately in the target DCS and PCS bands (1700 MHz to 1800 MHz).

Also, FIG. 11(*c*) is a so-called Smith chart showing an impedance matching property between the second antenna 102 and the power feeding line, both acting as loads. FIG. 11(*d*), as in the case of FIG. 7(*d*), shows data representing radiation efficiency of the antenna device 11 The data in FIG. 11(*d*) shows that radiation efficiency of about 100% is obtained in the bands of 1600 MHz to 2000 MHz and, in the antenna device 11 of the embodiment, a satisfactory radiation efficiency is achieved in bands of 1700 MHz/1800 MHz being frequencies in the DCS and PCS bands to be used.

FIGS. 12(*a*), 12(*b*), 12(*c*), and 12(*d*) show stereoscopically (three-dimensionally) directivity of the antenna device 11 of the embodiment in the DCS and PCS bands, out of the antenna properties, in the same way as employed in FIGS. 8(*a*), 8(*b*), 8(*c*), and 8(*d*).

Figure 13:
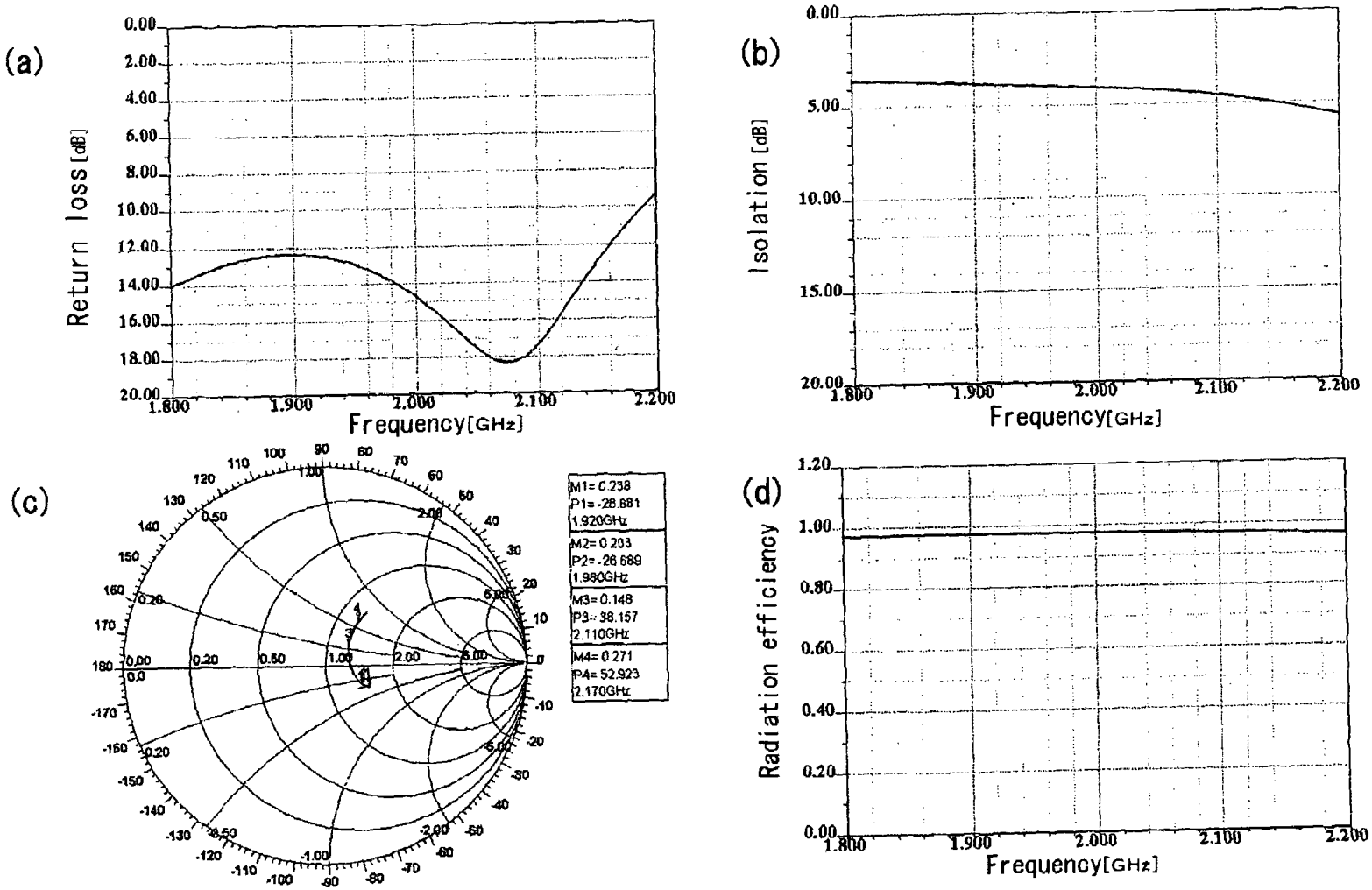
FIG. 13 is a diagram showing antenna properties of the antenna device in the UMTS band according to the first example of the first embodiment.
Figure 14:
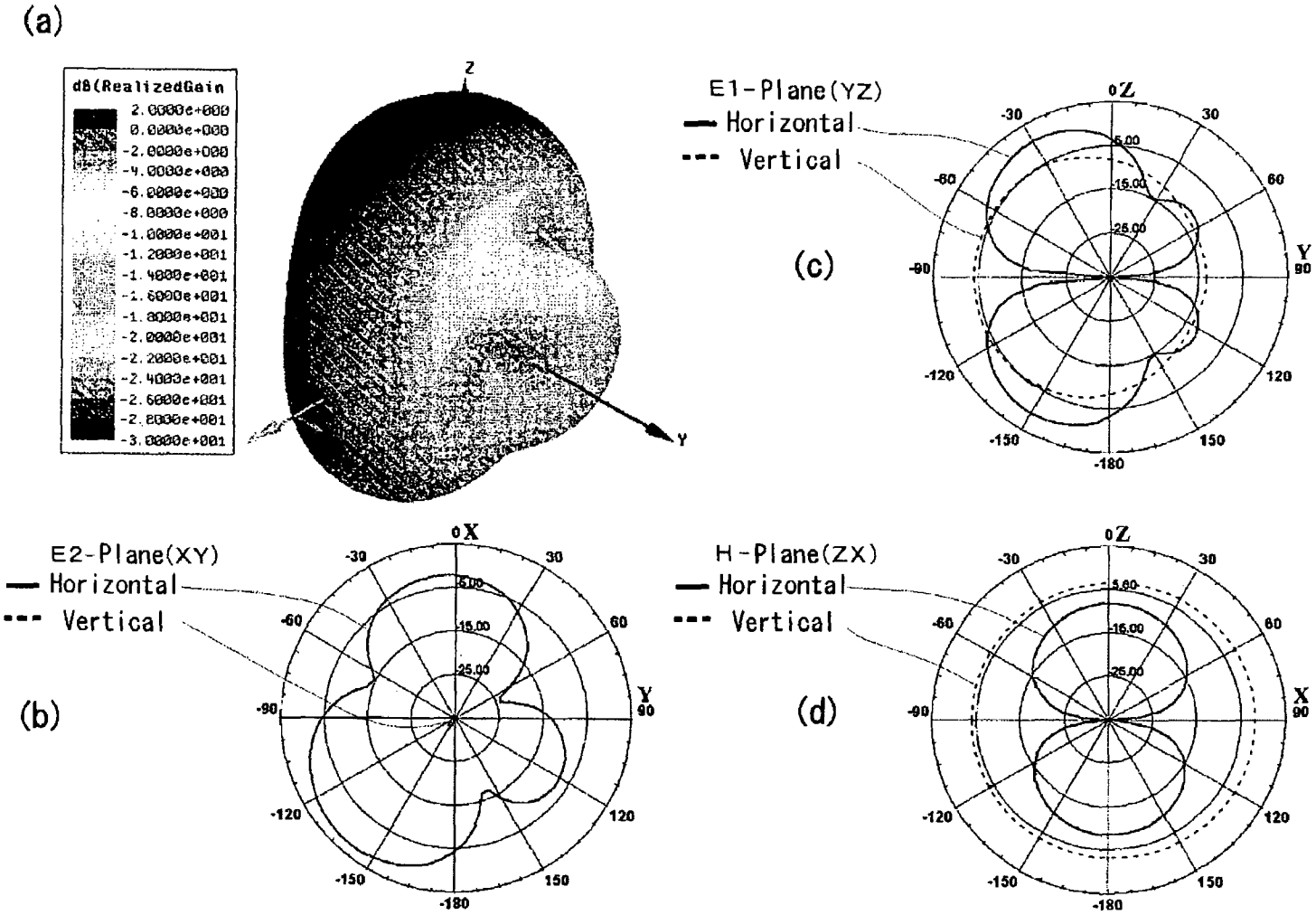
FIG. 14 is a diagram showing antenna properties of the antenna device in the UMTS band according to the first example of the first embodiment of the present invention.

The data on the directivity of the antenna device 11 on the Z-X face shown in FIG. 12(*d*) shows that the curve Vertical) representing directivity of vertically polarized waves is a uniform circle (true circle) and, unlike in the case of the above comparison example, no drop (null point in the comparison example) in gain in the X direction is observed and, as a result, uniform directivity, that is, uniform gain is obtained FIGS. 13 and 14 show antenna properties of the antenna device 11 of the embodiment in the UMTS band FIG. 13(*a*) shows data on return loss of the third antenna 103. The return loss of the third antenna 103 is represented as a value of return loss relative to a frequency [GHz] in the UMTS band occurring on the power feeding port 106 side.

In the data shown in FIG. 13(*a*), a satisfactory value of 6.00 dB or more (exactly, 9.00 dB or more) is obtained in 1800 MHz to 2200 MHz, which shows that a sufficient antenna property is realized in the bands of 1900 MHz/2200 MHz being frequencies to be applied to the UMTS bands to be used Additionally, since a sufficient value is obtained in a frequency range other than the above range, it is confirmed that the antenna device 11 can be used in a wider band in the UMTS band.

Moreover, FIG. 13(*b*) shows an isolation property of the antenna device 11, out of the antenna properties of the antenna device 11 in the UMTS band, which is expressed as a degree of separation of power from one antenna to another antenna relative to a frequency [GHz].

In the data shown in FIG. 13(*b*), a value of 3.00 dB or more is obtained in the range of 1800 MHz to 2200 MHz. Also, FIG. 13(*c*) is a Smith chart showing an impedance matching property of the antenna device 11 between the third antenna 103 and the power feeding line 107, both acting as loads. FIG. 13(*d*) show data representing radiation efficiency of the antenna device 11.

The data in FIG. 13(*d*) shows that radiation efficiency of about 100% is obtained in the bands of 800 MHz to 2200 MHz and a satisfactory radiation efficiency is achieved in bands of 1900 MHz to 2200 MHz being frequencies in the S band to be used.

FIGS. 14(*a*), 14(*b*), 14(*c*), and 14(*d*) show stereoscopically (three-dimensionally) directivity of the antenna device 11 of the embodiment in the UMTS band, out of the antenna properties.

The data on the directivity of the antenna device 11 on a Z-X face shown in FIG. 14(*d*) shows that the curve (Vertical) representing directivity of vertically polarized waves is a uniform circle (true circle) and no drop (null point) in gain in the X direction is observed and, as a result, uniform directivity, that is, uniform gain is obtained.

As described above, the data on the antenna directivity on the Z-X face in FIG. 12(*d*) and the data on the antenna directivity on the Z-X face in FIG. 14(*d*) of the antenna device 11 show that the problem of the null point is solved, that is, it can be confirmed that non-directivity of vertically polarized waves in a circumferential direction of the substrate is realized in the DCS, PCS, and UMTS bands.

The inventor of the present invention studied the reason for the above and assumes as follow. That is, in the antenna device CE used as the comparison example, only one power feeding port is mounted and electrostatic capacity between an end of the conductor pattern making up the second antenna 102 and a grounding electrode (grounding conductor) 114 acts dominantly, however, in the antenna device 11 of the embodiment, electrostatic capacity occurs between an end of the conductor pattern making up the second antenna 102 and the third antenna 103. The two power feeding ports 104 and 106 are arranged so as to be symmetric to each other with respect to a central line of the substrate 100 in the longitudinal direction and, between the two power feeding ports 104 and 106, a node of an electromagnetic wave having a ½ waveform in the PCS and UMTS bands is formed and a resonant current from the second antenna 102 and a resonant current and a resonant current from the third antenna 103 flow between the power feeding port 104 of the second antenna 102 and the power feeding port 106 of the third antenna 103.

Thus, according to the antenna device 11 of the embodiment, by additionally mounting the third antenna 103 which enables transmission and receipt of signals in the UMTS band, it is made possible for the antenna device 11 to be used in a multi-band environment and, in particular, non-directivity of vertically polarized waves in a short circumferential direction of the substrate 100 in the DCS, PCS, and UMTS bands is realized, thus improving performance of the antenna device 11 operating as a mobile phone terminal.

As described above, the antenna device 11 of the embodiment has the first antenna 101 operating in the GSM band, second antenna 102 operating in the DCS and PCS bands, and third antenna 103 operating in the UMTS, which enables realization of quad-band communications.

Moreover, the second antenna 102 is so arranged as to branch off from the line 105 on the power feeding side which connects the first antenna 101 to the power feeding port 106 Therefore, signals can be processed by the same transmitting and receiving circuit 108, which enables simplification and space saving of the configurations of the antenna device 11.

Moreover, by mounting the first antenna 101, second antenna 102, and third antenna 103 on the same surface of the substrate 100 and by configuring the first antenna 101 and second antenna 102 as the chip-type antenna, an entire size of the antenna device 11 of the embodiment can be made smaller. In particular, by electrostatically and capacitively coupling the second antenna 102 operating in the DCS and PCS bands to the third antenna 103 operating in the UMTS band, the problem of the null point described above can be solved and, therefore, non directivity of vertically polarized waves in the DCS and PCS bands and in the UMTS band can be maintained.

Moreover, in the antenna device 11 of the embodiment, all of the first antenna 101, second antenna 102, and third antenna 103 are mounted on a main surface (surface for mounting components) and, therefore, manufacturing processes of the antenna device 11 can be simplified.

Also, in the antenna device 11 of the embodiment, the second antenna 102 is arranged in a place being apart from the grounding electrode (grounding conductor) 114 when compared with the first antenna 101. By configuring as above, it is possible to make the antenna device 11 operate in wider bands in the DCS and PCS bands in which comparatively wide band width is required and possible to easily achieve high gain.

Thus, according to the antenna device 11 of the embodiment, smaller-sized antennas are mounted in every transmitting and receiving circuit and the antennas mounted in every transmitting and receiving circuit are arranged so as to be mutually used electromagnetically and, therefore, the antenna device 11 can be made small and space-saving and, furthermore, an impedance matching property of each antenna can be improved and excellent gain can be obtained and non-directivity can be maintained in wider bands (in a plurality of transmitting and receiving frequency bands) and in each band of transmitting and receiving frequencies.

Figure 15:
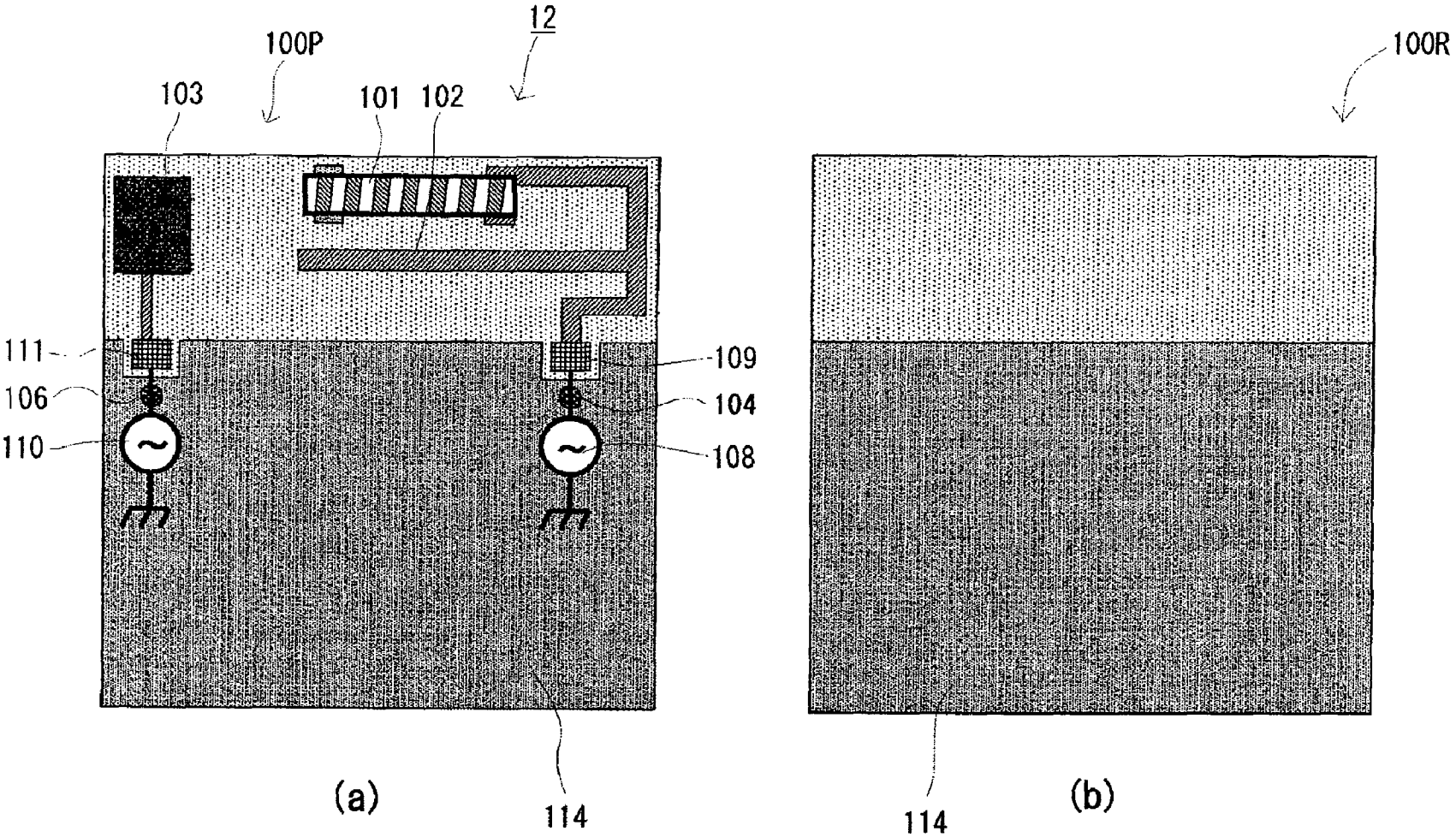
FIG. 15 is a diagram showing basic configurations of an antenna circuit according to the second example of the first embodiment of the present invention and FIG. 15(*a*) is a diagram showing an antenna mounting main surface side of its substrate and FIG. 15(*b*) is a diagram showing a rear side of the substrate.

Next, the antenna device of a second example of the first embodiment of the present invention is shown in FIG. 15. FIG. 15 is a diagram showing basic configurations of an antenna circuit of the antenna device 12 according to the second example of the first embodiment of the present invention. FIG. 15(*a*) is a diagram showing an antenna mounting main surface side of its substrate and FIG. 15(*b*) is a diagram showing a rear side of the substrate.

As shown in FIGS. 15(*a*) and 15(*b*), configurations of the antenna device 12 of the second example are the same as those of the antenna device 11 except that arrangement of the first antenna 101 and second antenna 102 is replaced, that is, the second antenna 102 is mounted on a side nearer to the grounding electrode (grounding conductor) 114 when compared with the first antenna 101. In FIGS. 15(*a*) and 15(*b*), same reference numbers as used in the antenna device 114 are assigned to corresponding components and their descriptions are omitted accordingly.

There is a trade-off between distance of the first antenna 101 and second antenna 102 from the grounding electrode (grounding conductor) 114 and their bands and gain.

That is, if a distance between an antenna and a grounding portion becomes nearer, capacitive components increase and, therefore, a current of opposite phase to cancel the resonant current generated in the antenna is liable to occur in the grounding portion, as a result, causing a drop in antenna gain.

In the second example of the first embodiment, to place importance on the first antenna 101 for using the GSM band being a low frequency band as wide bands and for obtaining high gain of the first antenna 101, the first antenna 101 is arranged in a place being far from the grounding electrode (grounding conductor) 114.

Figure 16:
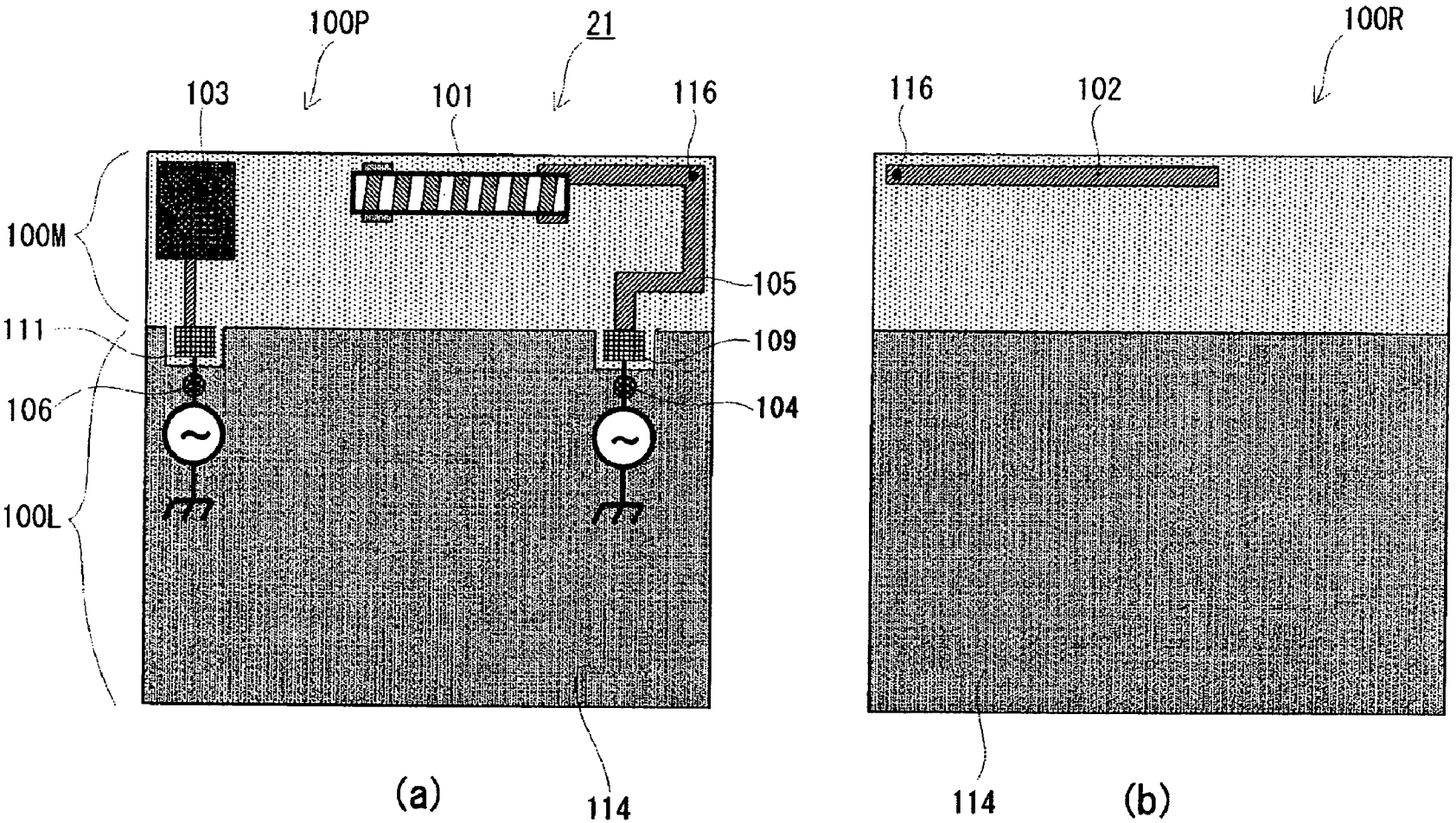
FIG. 16 is a diagram showing basic configurations of an antenna circuit according to the first example of the second embodiment of the present invention and FIG. 16(*a*) is a diagram showing an antenna mounting main surface side of its substrate and FIG. 16(*b*) is a diagram showing a rear side of the substrate.

Next, the antenna device of a first example of a second embodiment of the present invention is shown in FIG. 16. FIG. 16 shows basic configurations of antenna circuits of the antenna device 21 of the first example of the second embodiment and FIG. 16(*a*) shows its antenna main mounting face on a substrate and FIG. 16(*b*) shows a rear of the substrate. Basic configurations of the antenna device 21 of the first example of the second embodiment are the same as those of the antenna device of the first and second example of the first embodiment and same reference numbers are assigned to corresponding parts and their descriptions are omitted accordingly.

In the antenna device 21 of the first example of the second embodiment, as shown in FIGS. 16(*a*) and 16(*b*), the first antenna 101 is mounted on the main face (surface) of the substrate 100 and the second antenna 102 is mounted on the rear face 100R of the substrate 100. The second antenna 102 is connected to a line 105 for the first antenna 101 formed on the main surface 100P on a power feeding side via a through hole electrode 116.

Operations of the antenna device 21 are the same as those of the antenna devices of the first and second examples of the first embodiment in that signals in the GSM band being a transmitting and receiving frequency band for the first antenna 101 and signals in the DCS and PCS bands being a transmitting and receiving frequency band for the second antenna 102 are processed by the same transmitting and receiving circuit and in that a pattern antenna making up the second antenna 102 is connected to the line 105 which connects a chip antenna making up the first antenna 101 to a power feeding point 104.

However, in the antenna device 21 of the first example of the second embodiment, as is apparent from FIGS. 16(*a*) and 16(*b*), the first antenna 101 and the third antenna 103 are mounted on the main surface (face for mounting components) 100P of the substrate 100 and the second antenna 102 is mounted on the rear face 100R of the substrate 100 in a manner to be connected to the line 105 through the through hole electrode 116. By configuring as above, the arrangement position of the first antenna 101 in a Y direction is not approximately in a center of an antenna mounting region 100M but furthest end of the antenna mounting region 100M as in the case of the second antenna 102.

Therefore, in the antenna device 21, distances between the first antenna 101 and the grounding electrode (grounding conductor) 114 and between the second antenna 102 and the grounding electrode (grounding conductor) 114 are the same.

As a result, both the first antenna 101 and second antenna 102 can be arranged in places being far from the grounding electrode (grounding conductor) 114 and, therefore, both the first antenna 101 and second antenna 102 are made to operate in a wide band and to have high gain.

Moreover, a pattern antenna making up the antenna 102 is formed so as to be parallel to the first antenna 101 in a direction of a length of the first antenna 101 with a distance being equivalent to a thickness of the substrate 100.

Figure 17:
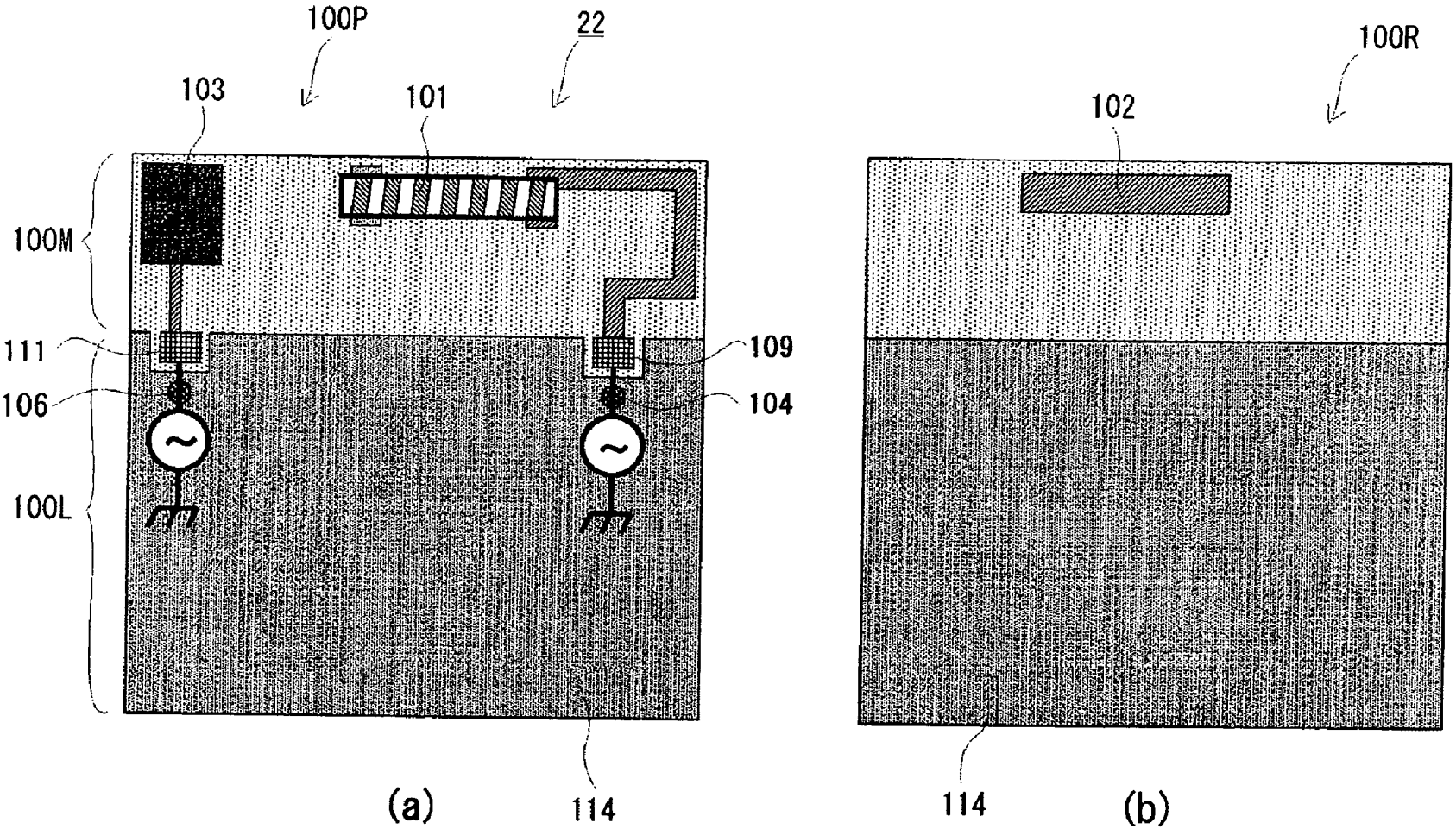
FIG. 17 is a diagram showing basic configurations of an antenna circuit according to the second example of the second embodiment of the present invention and FIG. 17(*a*) is a diagram showing an antenna mounting main surface side of its substrate and FIG. 17(*b*) is a diagram showing a rear side of the substrate.

Next, the antenna device 22 of a second example of the second embodiment of the present invention is shown in FIG. 17. FIG. 17 shows basic configurations of antenna circuits of the antenna device 22 of the second example of the second embodiment and FIG. 17(*a*) shows its antenna main mounting face on a substrate and FIG. 17(*b*) shows a rear of the substrate. The basic configurations of the antenna device 22 of the second example of the second embodiment are the same as those of the antenna device 21 of the first example of the second embodiment and same reference numbers are assigned to corresponding parts and their descriptions are omitted accordingly.

In the antenna device 22 of the second example, as shown in FIGS. 17(*a*) and 17(*b*), the first antenna 101 and third antenna 103 are mounted on the main surface 100P of the substrate 100 and the second antenna 102 made up of patterns each having the same width and length as the first antenna 101 is mounted on the rear 100R of the substrate 100 without forming a through hole electrode in a manner in which the patterns making up the second antenna 102 are positioned on the rear of the substrate 100 at a place corresponding to the position of the first antenna 101 mounted on the surface of the substrate 100.

That is, by arranging the second antenna 102 made up of the pattern antenna having the same width and length of the first antenna 101 at a position just on the rear of the substrate 100 so that the second antenna 102 faces the first antenna 101, it is made possible for the second antenna 102 to operate in a dual band of frequencies by using electrostatic and capacitive coupling between the first antenna 101 and second antenna 102.

Moreover, the second antenna 102 is configured so as to be wider and shorter compared with the first antenna 101. This is because the second antenna 102 mounted on the rear 100R of the substrate 100 without the use of the through hole electrode is made to operate in the DCS and PCS bands.

Figure 18:
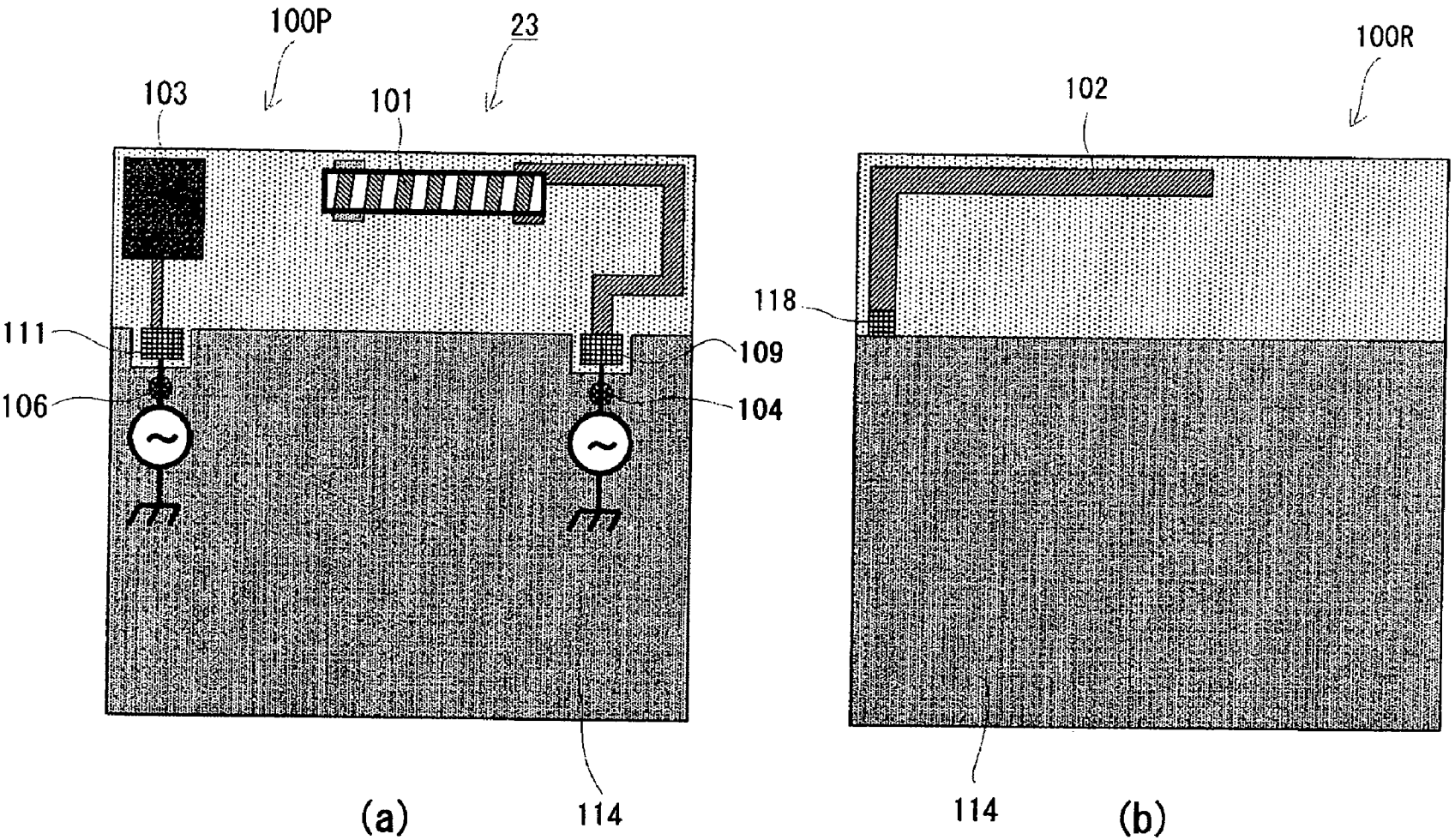
FIG. 18 is a diagram showing basic configurations of an antenna circuit according to the third example of the second embodiment of the present invention and FIG. 18(*a*) is a diagram showing an antenna mounting main surface side of its substrate and FIG. 18(*b*) is a diagram showing a rear side of the substrate.

Next, the antenna device of a third example of the second embodiment of the present invention is shown in FIG. 18. FIG. 18 shows basic configurations of antenna circuits of the antenna device 23 of the third example of the second embodiment and FIG. 18(*a*) shows its antenna main mounting face on a substrate and FIG. 18(*b*) shows a rear of the substrate 100.

The basic configurations of the antenna device 23 of the third example of the second embodiment are the same as those of the antenna device 22 of the second example of the second embodiment and same reference numbers are assigned to corresponding parts and their descriptions are omitted accordingly.

In the antenna device 23 of the third example, as shown in FIGS. 18(*a*) and 18(*b*), the first antenna 101 and third antenna 103 are mounted on a main surface 100P of the substrate 100 and the second antenna 102 is mounted without use of the through hole electrode on the rear 100R at a position being just on the rear side of the substrate 100.

That is, by arranging the second antenna 102 made up of a pattern antenna at a position just on the rear of the substrate 100, it is made possible for the second antenna 102 to operate in a dual band of frequencies by using electrostatic and capacitive coupling between the first antenna 101 and second antenna 102.

Moreover, the second antenna 102 is configured so as to be narrower and longer compared with the second antenna 102 used in the second example of the second embodiment. This is because the second antenna 102 mounted on the rear 100R of the substrate 100 without the use of the through hole electrode is made to operate in the DCS and PCS bands.

In the antenna device 23 of the third example, the first antenna 101, second antenna 102, and third antenna 103 have, respectively, impedance matching circuits 109, 111, and 118.

Each of the impedance matching circuits 109, 111, and 118 is a parallel resonance circuit made up of inductance (L) and capacity (C) and a VSWR value can be lowered by adjusting a value of L and C for impedance matching.

By inserting the impedance matching circuit 109 between a power feeding side of the first antenna 101 and a transmitting and receiving circuit section, the impedance matching circuit 111 between a power feeding side of the third antenna 103 and the transmitting and receiving circuit section, and the impedance matching circuit 118 between a power feeding side of the second antenna 102 and the grounding electrode 114, a value of VSWR can be optimally set in each of the GSM band, DCS/PCS band, and UMTS band.

Figure 19:
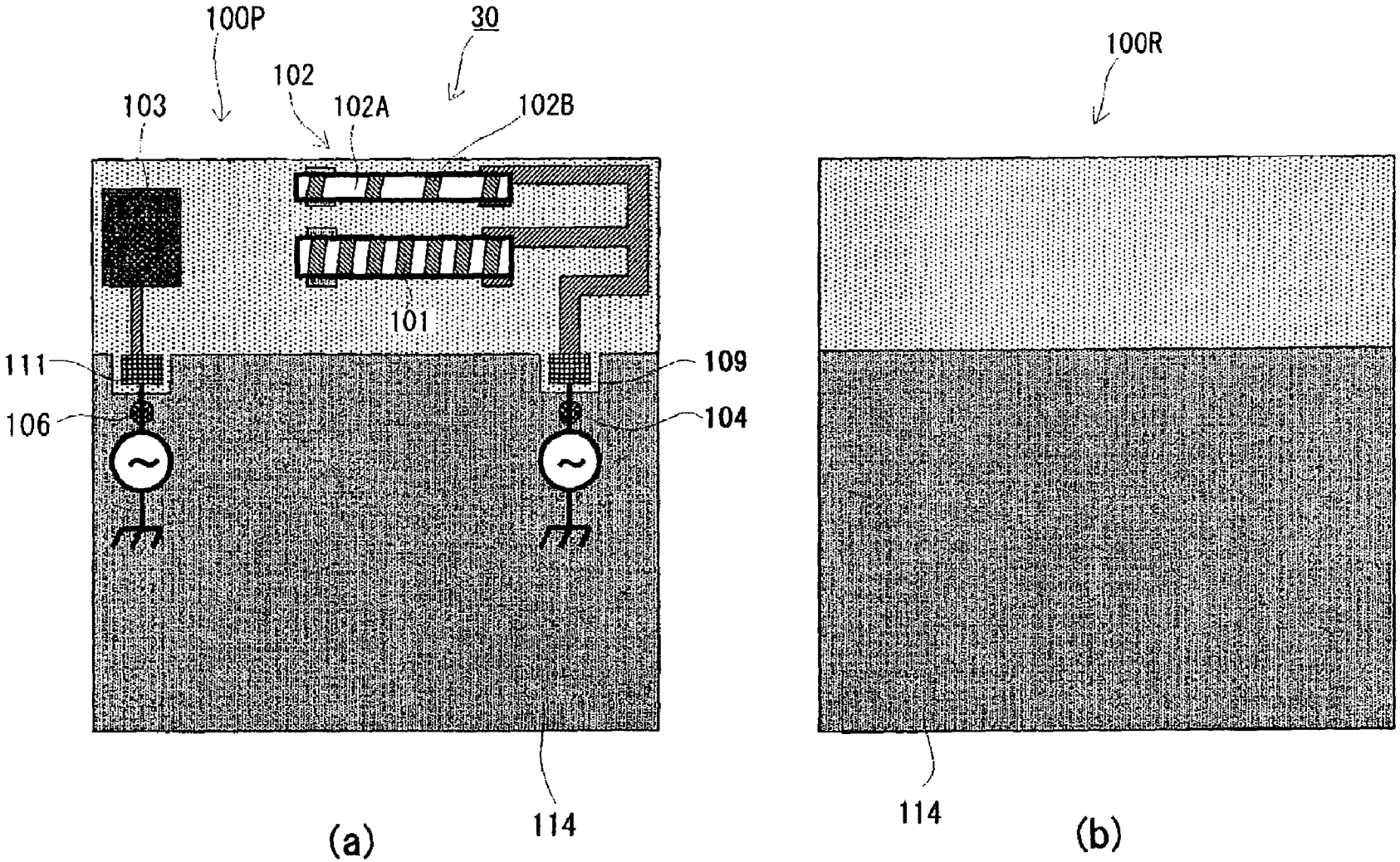
FIG. 19 is a diagram showing basic configurations of an antenna circuit according to the third embodiment of the present invention and FIG. 19(*a*) is a diagram showing an antenna mounting main surface side of its substrate and FIG. 19(*b*) is a diagram showing a rear side of the substrate.

Next, an antenna device of a third embodiment of the present invention is shown in FIG. 19. FIG. 19 shows basic configurations of antenna circuits of the antenna device 30 of the third embodiment and FIG. 19(*a*) shows its antenna main mounting surface on a substrate and FIG. 19(*b*) shows a rear of the substrate.

The basic configurations of the antenna device 30 of the third embodiment are the same as those of the antenna devices 11 and 12 of the first and second examples of the first embodiment and same reference numbers are assigned to corresponding parts and their descriptions are omitted accordingly.

In the antenna device 30 of the third embodiment, as shown in FIGS. 19(*a*) and 19(*b*), the second antenna 102 is configured as a chip antenna as for the first antenna 101.

That is, the second antenna 102 consists of a base body 102A made up of a dielectric and a conductor 102B wound around a surface of the base body 102A. However, the second antenna 102 is constructed so that its length is the same as that of the first antenna 101 and its width and height are smaller than that of the first antenna 101.

Also, the second antenna 102 is constructed so that an interval between the conductors 102B is larger than that applied to the first antenna 101 and so that the conductors 102B is wound around the base body 102A with a smaller number of windings compared with the number of windings used for the first antenna 101.

This is because the transmitting and receiving frequencies to be used by the second antenna 102 are higher than those used by the first antenna 101.

Moreover, a direction of winding of the conductor 102B is the same as that of the conductor 101B of the first antenna 101, however, since the frequency band to be used by the antenna 101 is sufficiently separated from that to be used by the antenna 102, no mutual influences occur.

This means that it is not always necessary that the directions of winding of the two antennas are the same if the frequency bands to be used by the two antennas are sufficiently separated from one another.

Figure 20:
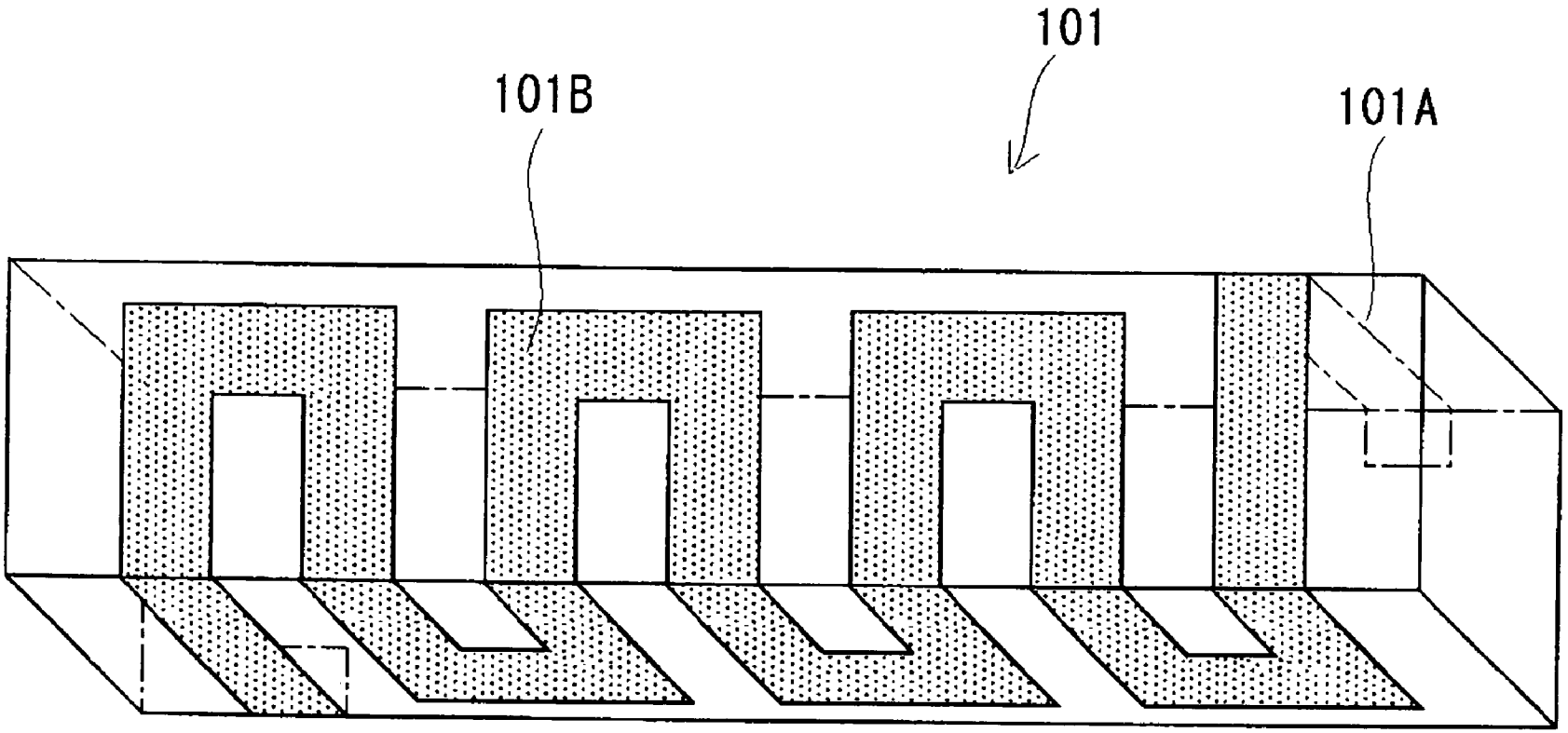
FIG. 20 is a diagram illustrating configurations of a chip-type antenna of a modified example.

Here, modified examples of a chip-type antenna and a layer-stacked antenna are described. FIG. 20 is a diagram showing configurations of the modified example of the chip-type antenna.

As shown in FIG. 20, in the chip-type antenna of the modified example, a shape and pattern of the conductor 101B are different from those of the chip antenna shown in FIG. 1. This pattern of the antenna electrode of the modified example can be generated by printing the conductors in a meandering manner without the process of winding.

Figure 21:
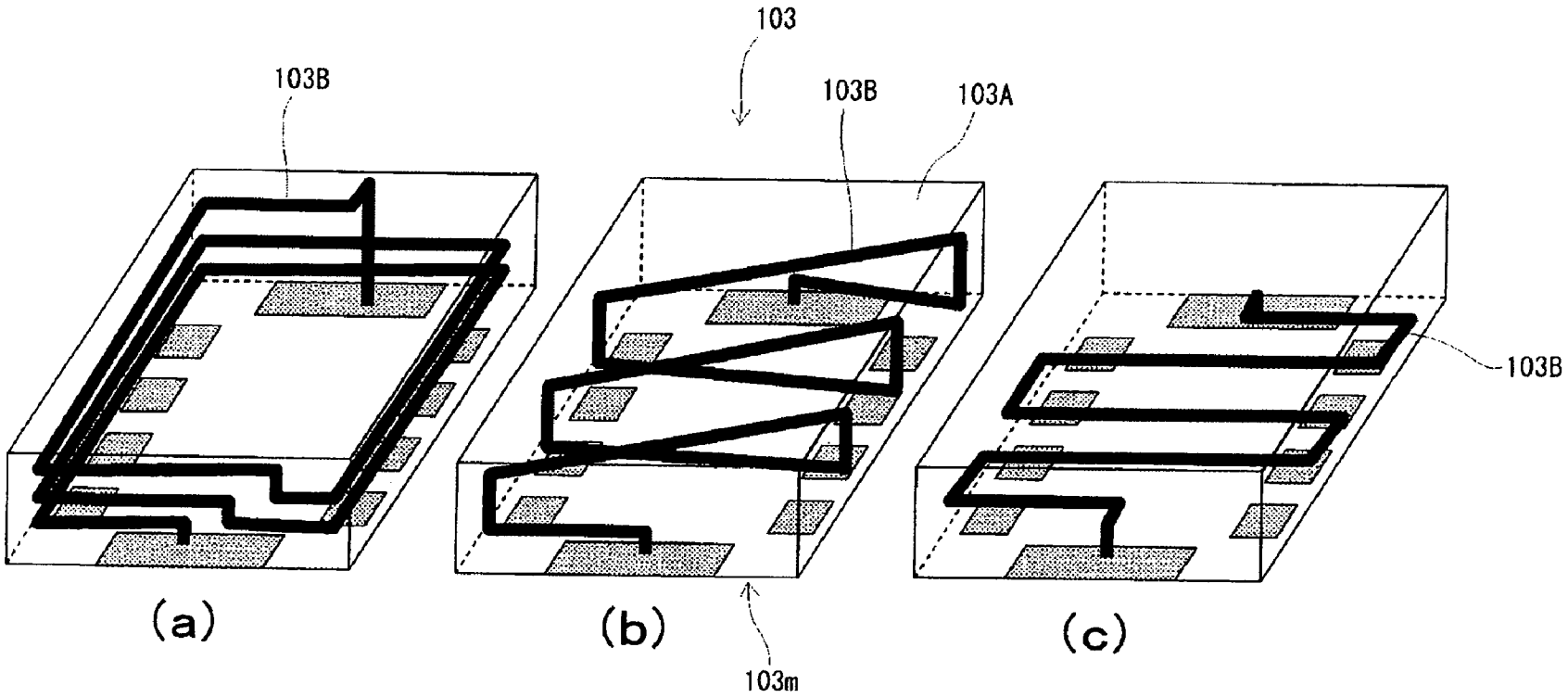
FIG. 21 is a diagram showing configurations of a layer-stacked antenna of a modified example and FIG. 21(*a*) is a modified example of the layer-stacked antenna and FIG. 21(*b*) is another example of the layer-stacked antenna.

FIG. 21 is a diagram illustrating configurations of a layer-stacked antenna of the modified example and FIG. 21(*a*) shows also a layer-stacked antenna of the modified example, FIG. 21(*b*) shows the layer-stacked antenna of the embodiment shown in FIG. 1, and FIG. 21(*c*) shows other modified example of a layer-stacked antenna.

Shapes and patterns of the conductor 103B shown in FIGS. 21(*a*), 21(*b*), and 21(*c*) are different from one another. Moreover, the length of the conductor 103B having a helical shape or a like is adjusted so as to provide frequencies corresponding to the UMTS band. However, the layer-stacked antenna of the embodiment shown in FIG. 21(*b*) is preferable as the layer stacked antenna to be used in the present invention.

That is, in the case of the layer-stacked antenna shown in FIG. 21 (*a*), there are some cases where the band width to be used is made narrow due to many overlapped portions of the L (conductors) and due to a large Q value caused by increased line-to-line capacity.

Also, in the case of the layer-stacked antenna shown in FIG. 21(*c*), there are some cases where a size of an antenna has to be increased if a same frequency is used due to an insufficient length of the L (conductor) caused by its plane and meandering shape.

In the layer-stacked antenna of the embodiment shown in FIG. 21(*b*), a large length of the L (conductor) can be ensured and overlapped portions of the L (conductors) are small and, therefore, its line-to-line capacity is made smaller, thus enabling the antenna to be smaller in size and its band width to be wider.

Figure 22:
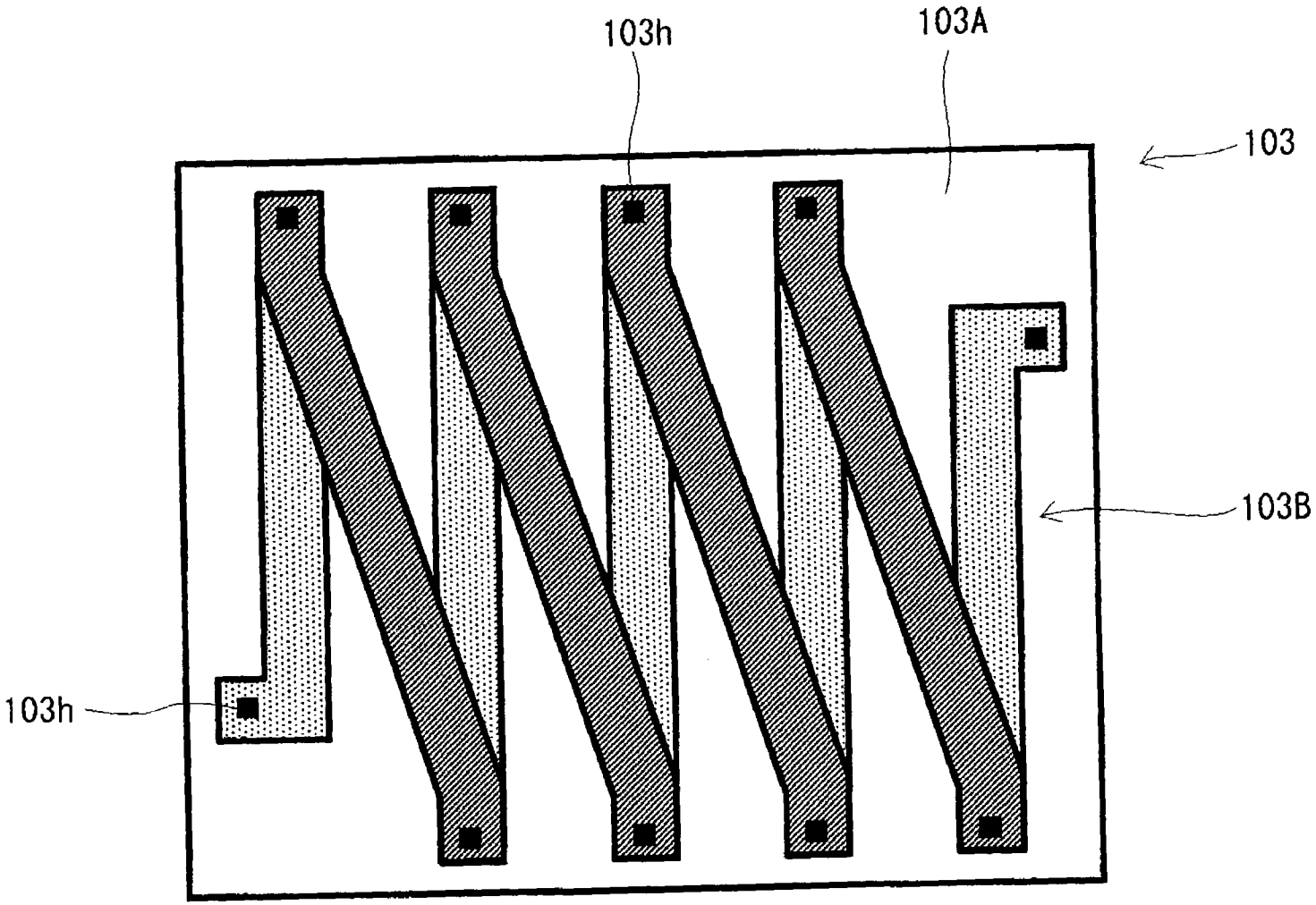
FIG. 22 is an expanded plan view of the another example of the layer-stacked antenna of FIG. 21(*b*)
Figure 23:
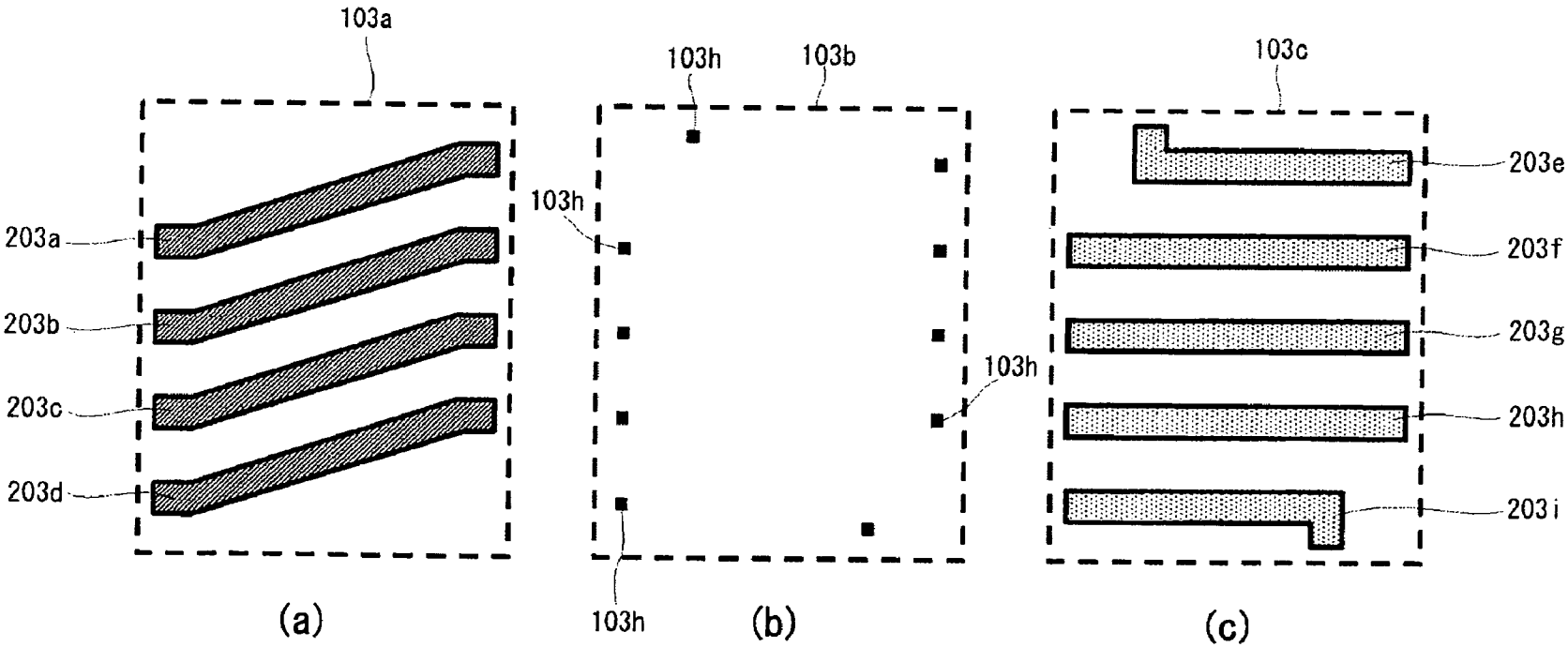
FIG. 23 is an exploded view of a sheet layer of the layer-stacked antenna of the embodiment shown in FIG. 1.

FIG. 22 is an expanded plan view of the layer-stacked antenna of the embodiment shown in FIG. 21(*b*). FIG. 23 is an exploded diagram of a sheet layer making up the layer-stacked antenna of the embodiment shown in FIG. 21(*b*).

The third antenna 103 of the embodiment described above is configured so as to have a conductor 103B which winds the base body 103A in a helical manner and in a longitudinal direction in the base body 103A of a cuboid shape whose one main surface (rear face in FIG. 21[*b*]) makes up its antenna main mounting face 103*m*.

The base body 103A, as shown in FIGS. 22 and 23, is constructed by stacking rectangular sheet layers 103*a*, 103*b*, and 103*c* made of dielectric materials containing, for example, aluminum oxide and silica as main components.

On the surfaces of the sheet layer 103*a* and 103*c* is formed conductive patterns 203*a* to 203*i* each having a straight line shape and made of silver, silver alloy, and copper or copper alloy. In the sheet layer 103*b* are formed through hole electrodes 103*h* in a direction of a length of the antenna.

Moreover, in the formation of the layer-stacked antenna, when a low-temperature firing material (such as an LTCC [Low Temperature Co-fired Ceramics]) made of, for example, glass and $Al_2O$ is used as a dielectric material, a firing process can be performed at temperatures of 800 to 1000° C. and, therefore, firing of a layer-stacking material together with an electrode material such as silver, copper, or a like is made possible.

As a result, when an electrode is formed, the conductive patterns 203*a* to 203*i* are formed on the surface of the layer-stacked material by using a silver paste or a like and the dielectric material and electrode films can be fired at the same temperature.

Then, by stacking the sheet layers 103*a*, 103*b*, and 103*c* and by connecting the conductive patterns 203*a* to 203*i* to the sheet layers 103*a*, 103*b*, and 103*c* via the through hole electrodes 103*h*, the conductive body 103B is fabricated with a rectangular wound-around cross section, which winds the base body 103A in a spiral.

Next, another mode of the present invention in which the antenna device having configurations described above is embedded in a wireless communication apparatus is described.

Figure 24:
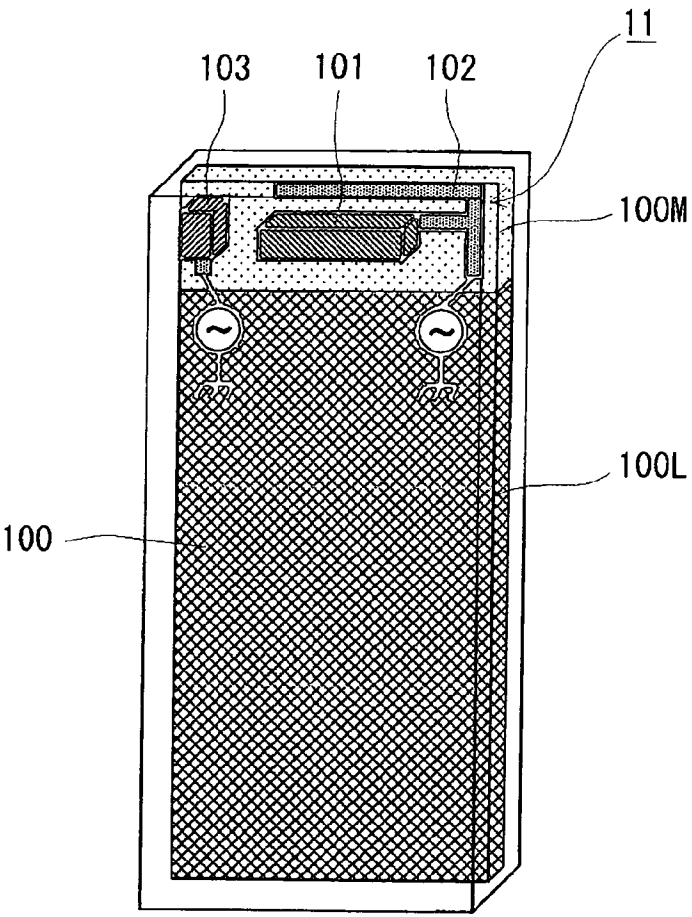
FIG. 24 is a diagram showing an example in which the antenna device of the embodiment of the present invention is applied to a stick-type mobile phone operating as a wireless communication apparatus and FIG. 24(*a*) is a diagram showing appearance of a mobile phone and 24(*b*) is a diagram showing a state in which the antenna device containing a substrate is embedded in the mobile phone.
Figure 24:
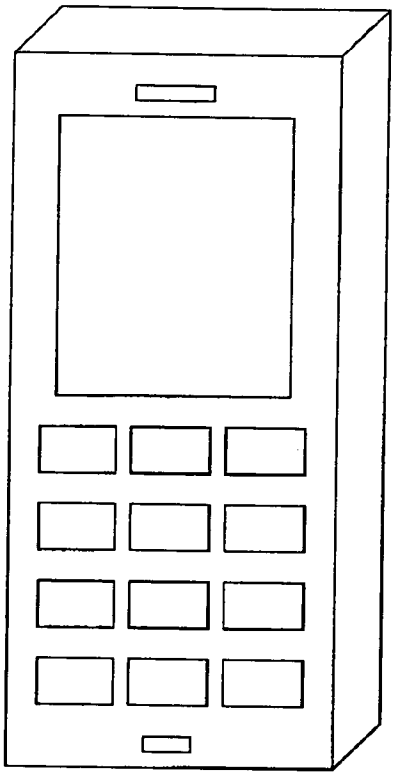
Figure 25:
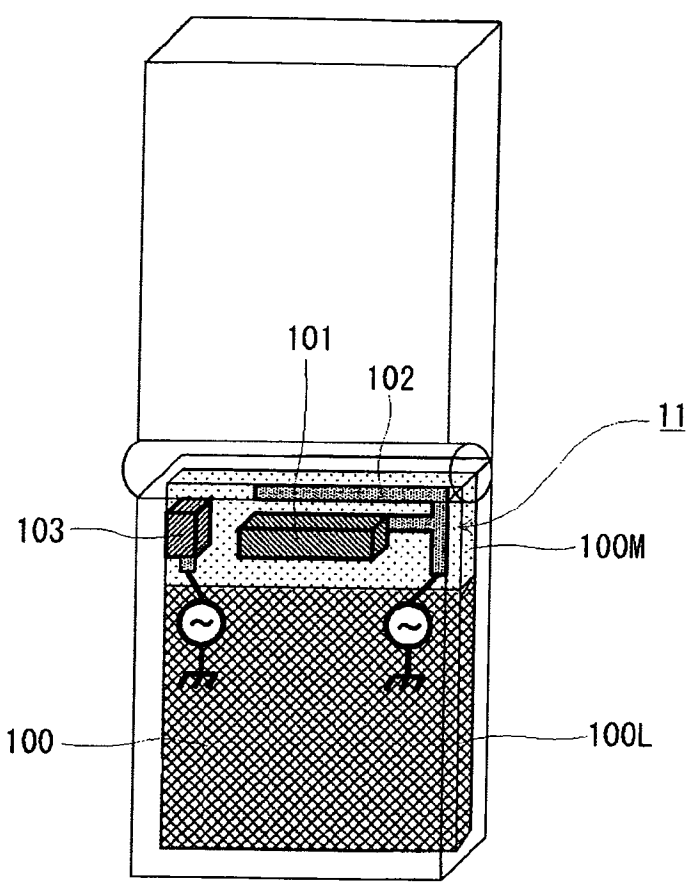
FIG. 25 is a diagram showing an example in which the antenna device of the embodiment of the present invention is applied to a folder type mobile phone operating as a wireless communication apparatus and FIG. 25(*a*) is a diagram showing appearance of a mobile phone and 25(*b*) is a diagram showing a state in which the antenna device containing a substrate is embedded in the mobile phone.
Figure 25:
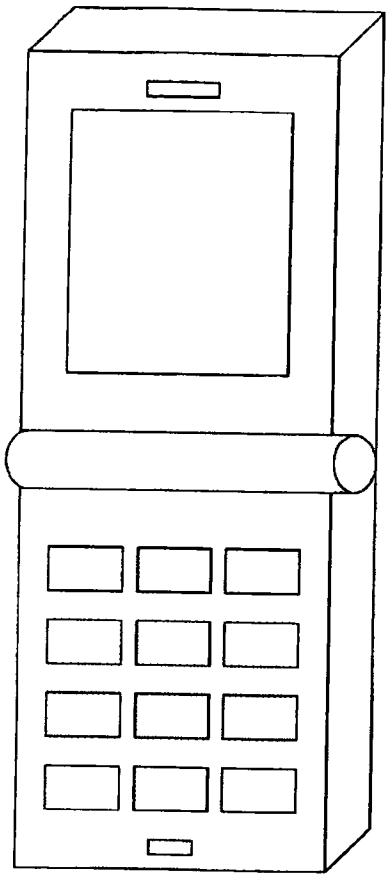
Figure 26:
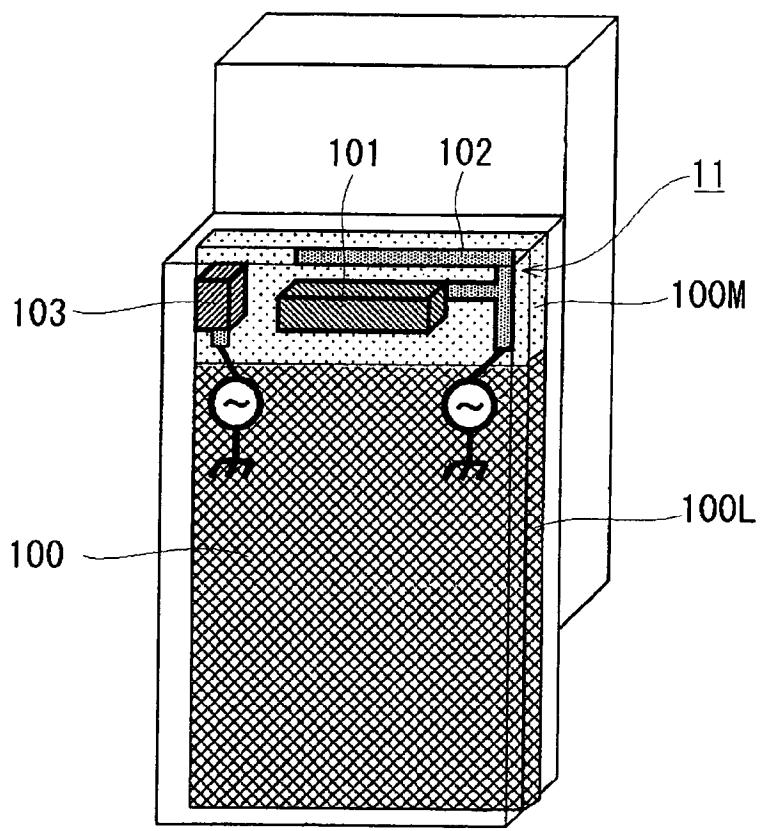
FIG. 26 is a diagram showing an example in which the antenna device of the embodiment of the present invention is applied to a sliding-type mobile phone operating as a wireless communication apparatus and FIG. 26(*a*) is a diagram showing appearance of a mobile phone and 26(*b*) is a diagram showing a state in which the antenna device containing a substrate is embedded in the mobile phone.
Figure 26:
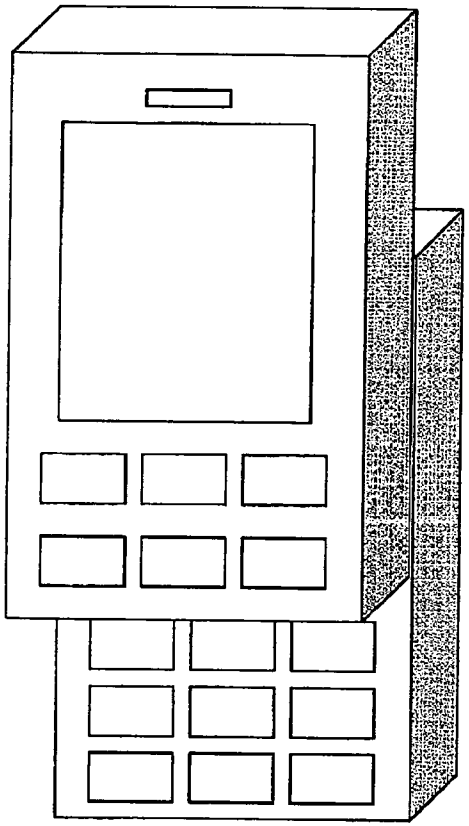

FIGS. 24 to 26 show examples in which the antenna device of the embodiment is applied to a mobile phone being one of wireless communication apparatuses and FIG. 24 shows an example in which the antenna device is applied to a stick-type mobile phone and FIG. 25 shows an example in which the antenna device is applied to a folder-type mobile phone and FIG. 26 shows an example in which the antenna device is applied to a sliding-type mobile phone.

FIGS. 24(*a*) and 26(*a*) are diagrams of appearances of the mobile phone terminal viewed from its surface side and FIG. 25(*b*) is a diagram illustrating a state in which the antenna device containing the substrate 100 is embedded in the mobile phone viewed from its rear side.

For example, many of the conventional plate antennas are configured so as to have a height of about 8 mm from the substrate to an upper top face of the plate antenna.

On the other hand, as described above, in the antenna device 11 of the embodiments of the present invention, one antenna is electrostatically and capacitively coupled to another antenna so that both the antennas are utilized mutually and less switches or a like are required and, therefore, it is made possible to make the antenna device small-sized and space-saving and a width of the antenna mounting region 100M occupied in a cabinet of a mobile phone in a longitudinal direction can be reduced to a half when compared with the conventional plate-type antenna.

Moreover, a thickness of the antenna mounting region 100M in the antenna device 11 can be about 3 mm (about 4 mm when containing the substrate).

A volume of the antenna mounting region 100M can be reduced to about one fourth compared with the conventional plate antenna and, therefore, it is made possible to save space for the antenna device in a mobile phone being a wireless communication apparatus and a degree of freedom of arrangement (layout) in a cabinet of the mobile phone is increased, thus enabling miniaturization of the mobile phone.

In the examples shown in FIGS. 24 to 26, the antenna mounting region 100M of the antenna device 11 is placed in an upper position in the cabinet of the mobile phone, however, the antenna mounting region 100M of the antenna device 11 may be placed in a lower position in the cabinet of the mobile phone.

In recent years, importance is attached to not only a function but also design of the mobile phone and further a mobile phone of a slightly tapered shape in its lower portion is prevailing. However, since the antenna device 11 is configured so as to be small-sized and thin, in response to the needs, layout in which the antenna mounting region 100M in the antenna device 11 is placed in a lower position in the cabinet of the mobile phone is possible.

Also, the layout in which the antenna mounting region 100M is placed in a lower position in the cabinet of the mobile phone is effective for preventing radio waves from being absorbed by hands of a user. Thus, by controlling the position of the antenna mounting region 100M, an influence by noises from a liquid crystal screen on the mobile phone can be minimized.

Moreover, as described above, in the antenna device 11 of the embodiments of the present invention, since non-directivity of vertically polarized waves in a short circumferential direction of the substrate 100 can be ensured, when the antenna device 11 is embedded in the cabinet of the mobile phone terminal, by mounting, as appropriate, a metal portion in a place surrounding the antenna mounting region 100M in the cabinet, it is made possible to control directivity of the antenna.

Figure 27:
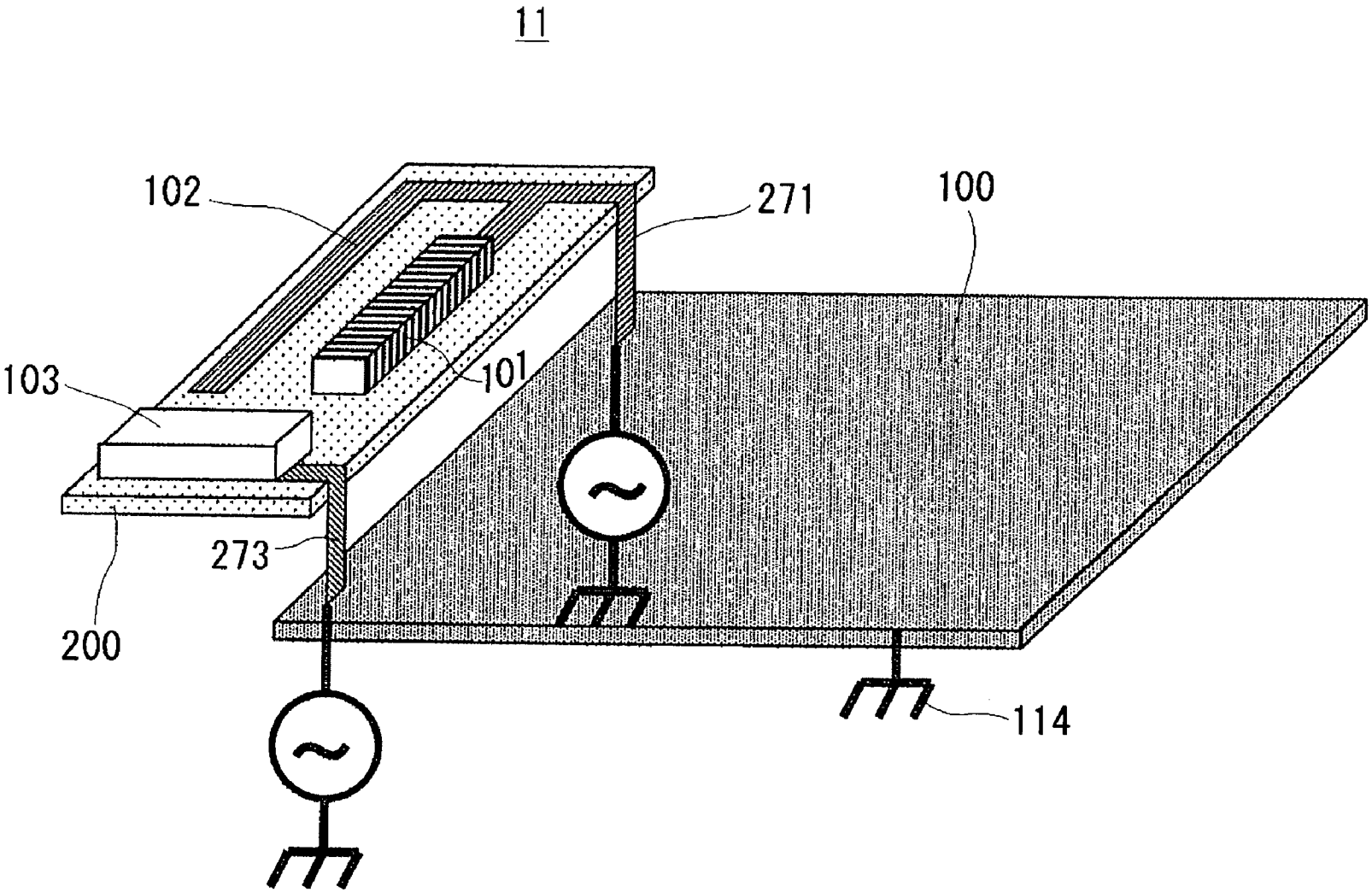
FIG. 27 is a diagram showing other example of mounting the antenna device of the embodiment of the present invention.

Other example of mounting the antenna device 11 of the embodiment of the present invention is described by referring to FIG. 27.

As shown in FIG. 27, a sub-substrate 200 for antennas is attached in addition to the grounded substrate 100 and the first, second, and third antenna 101, 102, and 103 are mounted on the added sub-substrate 200.

Power is fed to the first, second, and third antennas 101, 102, and 103 from a transmitting and receiving circuit mounted on the circuit substrate 100 via the power feeding lines 271 and 273.

The antenna device 11 of the embodiment is so configured as to be small-sized, thin, and space-saving, which allows the additional antenna sub-substrate, besides the substrate 100, to be mounted.

By configuring as above, a specified distance between the first antenna 101, second antenna 102, and third antenna 103 and the grounding electrode of the circuit substrate 100 can be kept, thereby enabling wide-band and high-gain type first, second, and third antennas 101, 102, and 103.

Moreover, though not shown, by providing a further additional sub-substrate, in addition to the antenna sub-substrate 200, and by mounting a transmitting and receiving circuit (signal processing circuit) for the GSM band, DCS band, and PCS band and another transmitting and receiving circuit (signal processing circuit) for the UMTS band on the further additional sub-substrate, a connecting terminal attached to each of the additional sub-substrates may be connected to each antenna via a coaxial cable.

In the embodiments described above, a grounding electrode is not provided between the first/second antennas and the third antenna and, as a result, a distance between these antennas and the grounding electrode is made larger, which decreases electrostatic and capacitive capacity between the antennas and grounding electrode and a resonant current of an opposite phase to cancel a resonant current occurring in the antennas.

However, radiation efficiency of radio waves radiated from the antennas is improved and non-directivity can be easily maintained, thus attributing to make the transmitting and receiving frequency band become wider.

As described above, the chip antenna of the embodiment can operate in wider bands (in a quad band of frequencies) including the GSM band, DCS band, PCS band, and UMTS bands and can provide excellent antenna gain and can maintain non-directivity of vertically polarized waves in each band of transmitting and receiving frequencies to be used and can save space.

It is apparent that the present invention is not limited to the above embodiments but may be changed and modified without departing from the scope and spirit of the invention.

For example, in the above embodiment, the second antenna 102 is configured so as to be able to operate in the DCS and PCS bands, which enables the antenna device of the embodiment to operate in a quad band of frequencies, however, it is needless to say that the second antenna 102 may be configured so as to operate in one transmitting and receiving frequency band, that is, in a triple band of frequencies.

In the above embodiments, both signals in the GSM band being the transmitting and receiving frequency band for the first antenna 101 and signals in the DCS and PCS bands being the transmitting and receiving frequency band for the second embodiment 102 are processed by the same transmitting and receiving circuit, however, these signals may be processed by a separate and individual transmitting and receiving circuit.

Also, in the above embodiments, in the GSM, DCS, and PCS bands, the same transmitting and receiving circuit is shared and, in the UMTS band, a power feeding port for the antenna is separately provided which is connected to the transmitting and receiving circuit and, therefore, it is not necessary to provide a complicated antenna switch conventionally required, when one antenna is shared in the GSM, DCS, PCS, and UMTS bands to switch the transmitting and receiving circuit between operations in the GSM, DCS, and PCS bands and operations in the UMTS band, thus enabling a decrease in insertion loss of the antenna device and in antenna mounting space.

Also, in the above embodiments, the example is described in which the base body of the chip antenna is made up of the dielectric material, however, the base body may be constructed by using a magnetic material or by combining the dielectric material and magnetic material.

For example, as the dielectric material, a green sheet made up of the LTCC that can be fired at low temperatures and, as the magnetic material, a green sheet made up of ferrite or a like that can be fired at low temperatures.

Moreover, it is not necessary that the third antenna 103 is made up of an inner layer-stacked pattern (layer-stacked antenna) and the third antenna 103 may be configured by winding electrodes around the surface of the base body made of a dielectric material, as in the case of the first antenna 101.

However, the inner layer-stacked pattern (layer-stacked antenna) is more advantageous for miniaturization of the antenna device.

This is because the width of the inner layer-stacked pattern (layer-stacked antenna) can be made narrower. If the third antenna is configured to be of the chip-type antenna as in the case of the first antenna, a pattern can be formed on a surface by using a screen printing method, however, it is necessary that the electrode to be used has a certain width to prevent breakdown of lines at the manufacturing process.

Moreover, the inner layer-stacked pattern (layer-stacked antenna) is more advantageous because a portion surrounding the conductor is dielectric which enables an increase in effective dielectric constant and, owing to this, further miniaturization of the antenna is made possible.

Furthermore, the antenna device of the present invention, so long as the antenna device includes the first antenna, second antenna, and third antenna wherein each of the first, second, and third antenna operates in transmitting and receiving frequency bands, each band being different from one another and the second antenna is connected to the same power feeding port as used by the first antenna and the third antenna is mounted with a gap being interposed between the third antenna and the first or second antenna, can be applied not only to a portable wireless communication apparatus but also to various wireless communication apparatuses.

What is claimed is:

1. An antenna device comprising:

a substrate;

a first antenna mounted on said substrate;

a second antenna mounted on said substrate; and a third antenna mounted on said substrate, wherein said first, second, and third antennas operates in first, second, and third transmitting and receiving frequency bands being different from one another and said first and second antennas are connected to a transmitting and receiving circuit via a first power feeding port and said third antenna is connected to said transmitting and receiving circuit via a second power feeding port being different from said first power feeding port and said first or second antenna and said third antenna are mounted on said substrate with a gap interposed between said first or second antenna and said third antenna.

2. The antenna device according to claim 1, wherein said first power feeding port is mounted nearer to one side relative to a center of said substrate and said second power feeding port is mounted nearer to one side being opposite to said one side relative to said center of said substrate.

3. The antenna device according to claim 1, wherein said second antenna is connected to a line extending from said first power feeding port connected to said first antenna.

4. The antenna device according to claim 1, wherein said second antenna comprises a pattern antenna comprising a conductor pattern formed on said substrate.

5. The antenna device according to claim 1, wherein said second transmitting and receiving frequency band to be used in said second antenna contains transmitting and receiving frequency bands to be used in at least two communication systems.

6. The antenna device according to claim 1, wherein said first, second and third antennas are mounted on a surface of said substrate.

7. The antenna device according to claim 1, wherein said second antenna and third antenna are mounted on said substrate with a gap interposed between said second antenna and said third antenna.

8. The antenna device according to claim 1, wherein no grounding electrode is provided between said first and second antennas and said third antenna.

9. A communication apparatus embedding the antenna device of claim 1.

10. An antenna device according to claim 1, wherein a distance between the first and second power feeding ports is such a distance by which a node of an electromagnetic wave having a ¼ waveform in the OSM band or a ½ waveform in the DCS, PCS, and UMTS bands is formed.

11. An antenna device according to claim 1, wherein a distance between the first and second power feeding ports is such a distance by which a node of an electromagnetic wave having a ¼ waveform or a ½ waveform in the at least one of the transmitting and receiving frequency bands.

12. An antenna device comprising:

a substrate;

a first antenna mounted on said substrate;

a second antenna mounted on said substrate; and a third antenna mounted on said substrate, wherein said first, second, and third antennas operates in transmitting and receiving frequency bands being different from one another and said first and second antennas are connected to a transmitting and receiving circuit via a first power feeding port and said third antenna is connected to said transmitting and receiving circuit via a second power feeding port being different from said first power feeding port and said first or second antenna and said third antenna are mounted on said substrate with a gap interposed between said first or second antenna and said third antenna so that said first or second antenna is electrostatically and capacitively coupled to said third antenna.

13. The antenna device according to claim 12, wherein said first power feeding port is mounted nearer to one side relative to a center of said substrate and said second power feeding port is mounted nearer to one side being opposite to said one side relative to said center of said substrate.

14. The antenna device according to claim 12, wherein said second antenna is connected to a line extending from said first power feeding port connected to said first antenna.

15. The antenna device according to claim 12, wherein said second antenna comprises a pattern antenna comprising a conductor pattern formed on said substrate.

16. The antenna device according to claim 12, wherein said second transmitting and receiving frequency band to be used in said second antenna contains transmitting and receiving frequency bands to be used in at least two communication systems.

17. An antenna device comprising:

a substrate;

a first antenna mounted on said substrate;

a second antenna mounted on said substrate; and a third antenna mounted on said substrate, wherein said first, second, and third antennas operates in first, second, and third transmitting and receiving frequency bands being different from one another and said first and second antennas are connected to a transmitting and receiving circuit via a first power feeding port and said third antenna is connected to said transmitting and receiving circuit via a second power feeding port being different from said first power feeding port and said first or second antenna and said third antenna are mounted on said substrate with a gap interposed between said first or second antenna and said third antenna, wherein said first transmitting and receiving frequency band to be used in said first antenna comprises a band of frequencies being less than frequencies to be used in said second and third antennas, and wherein said first antenna comprises a chip-type antenna comprising a base body made of at least one of a dielectric material and a magnetic material and a conductor attached to said base body.

18. An antenna device comprising:

a substrate;

a first antenna mounted on said substrate;

a second antenna mounted on said substrate; and a third antenna mounted on said substrate, wherein said first, second, and third antennas operates in first, second, and third transmitting and receiving frequency bands being different from one another and said first and second antennas are connected to a transmitting and receiving circuit via a first power feeding port and said third antenna is connected to said transmitting and receiving circuit via a second power feeding port being different from said first power feeding port and said first or second antenna and said third antenna are mounted on said substrate with a gap interposed between said first or second antenna and said third antenna, and wherein said third transmitting and receiving frequency band to be used in said third antenna comprises a band of frequencies being greater than transmitting and receiving frequencies to be used in said second antennas and wherein said third antenna comprises a chip-type antenna comprising a base body made of at least one of a dielectric material and a magnetic material and conductors attached to said base body.

19. The antenna device according to claim 18, wherein said third antenna comprises a layer-stacked antenna comprising said base body comprising a plurality of layers and said conductors arranged in said plurality of layers.

20. An antenna device comprising:

a substrate;

a first antenna mounted on said substrate;

a second antenna mounted on said substrate; and a third antenna mounted on said substrate, wherein said first, second, and third antennas operates in first, second, and third transmitting and receiving frequency bands being different from one another and said first and second antennas are connected to a transmitting and receiving circuit via a first power feeding port and said third antenna is connected to said transmitting and receiving circuit via a second power feeding port being different from said first power feeding port and said first or second antenna and said third antenna are mounted on said substrate with a gap interposed between said first or second antenna and said third antenna, and wherein said first antenna is mounted on a main surface of said substrate and said second antenna is mounted on a rear of said main surface of said substrate and is connected to said first antenna mounted on said main surface via a through hole electrode connected to a line to connect said first antenna to said first power feeding port.

21. An antenna device comprising:

a substrate;

a first antenna mounted on said substrate;

a second antenna mounted on said substrate; and a third antenna mounted on said substrate, wherein said first, second, and third antennas operates in first, second, and third transmitting and receiving frequency bands being different from one another and said first and second antennas are connected to a transmitting and receiving circuit via a first power feeding port and said third antenna is connected to said transmitting and receiving circuit via a second power feeding port being different from said first power feeding port and said first or second antenna and said third antenna are mounted on said substrate with a gap interposed between said first or second antenna and said third antenna, and wherein said first antenna is mounted on a main surface of said substrate and said second antenna is mounted on a rear of said main surface with said substrate being interposed between said first and second antennas so that said first antenna faces said second antenna and so that said second antenna is electrostatically and capacitively coupled to said first antenna and so that said second antenna is connected to said first power feeding port.

22. An antenna comprising:

a substrate;

a first antenna mounted on said substrate;

a second antenna mounted on said substrate; and a third antenna mounted on said substrate, wherein said first, second, and third antennas operates in transmitting and receiving frequency bands being different from one another and said first and second antennas are connected to a transmitting and receiving circuit via a first power feeding port and said third antenna is connected to said transmitting and receiving circuit via a second power feeding port being different from said first power feeding port and said first or second antenna and said third antenna are mounted on said substrate with a gap interposed between said first or second antenna and said third antenna so that said first or second antenna is electrostatically and capacitively coupled to said third antenna, wherein said first transmitting and receiving frequency band to be used in said first antenna comprises a band of frequencies being lower than frequencies to be used in said second and third antennas, and wherein said first antenna comprises a chip-type antenna comprising a base body made of at least one of a dielectric material and a magnetic material and a conductor attached to said base body.

* * * * *